US009287658B2

(12) United States Patent
Lewin

(10) Patent No.: US 9,287,658 B2
(45) Date of Patent: Mar. 15, 2016

(54) CONNECTOR UNIT

(71) Applicant: Richard Lewin, Ulverston (GB)
(72) Inventor: Richard Lewin, Ulverston (GB)
(73) Assignee: Siemens Aktiengesellschaft, München (DE)

( * ) Notice: Subject to any disclaimer, the term of this patent is extended or adjusted under 35 U.S.C. 154(b) by 0 days.
(21) Appl. No.: 14/499,164
(22) Filed: Sep. 27, 2014
(65) Prior Publication Data
US 2015/0093921 A1 Apr. 2, 2015
(30) Foreign Application Priority Data
Sep. 27, 2013 (EP) ..... 13186409
(51) Int. Cl.
*H01R 13/639* (2006.01)
*H01R 13/62* (2006.01)
*H01R 13/523* (2006.01)
*H01R 13/627* (2006.01)
*H01R 4/48* (2006.01)
*H01R 13/52* (2006.01)
*H01R 43/26* (2006.01)
(52) U.S. Cl.
CPC ..... *H01R 13/6205* (2013.01); *H01R 4/48* (2013.01); *H01R 13/523* (2013.01); *H01R 13/5219* (2013.01); *H01R 13/627* (2013.01); *H01R 13/6276* (2013.01); *H01R 43/26* (2013.01); *Y10T 29/49208* (2015.01)
(58) Field of Classification Search
CPC .. H01R 13/6205; H01R 13/639; H01R 11/30; H01R 13/62; H01R 13/6276
See application file for complete search history.

(56) References Cited

U.S. PATENT DOCUMENTS 4,525,918 A * 7/1985 Puritz ..... B23B 31/1074 279/89
4,690,495 A 9/1987 Giannini
5,136,196 A * 8/1992 Schmidt ..... B25J 5/00 310/12.19
5,385,271 A * 1/1995 Bierend ..... B65D 83/16 222/153.14
7,389,750 B1 * 6/2008 Rogers ..... A01K 27/005 119/792
2007/0139039 A1 * 6/2007 Steinich ..... G01D 5/485 324/207.11
2008/0207028 A1 * 8/2008 Schutz ..... A61B 1/00114 439/191
2011/0137452 A1 * 6/2011 Boyes ..... B23B 3/165 700/213
2015/0093921 A1 * 4/2015 Lewin ..... H01R 13/523 439/39

FOREIGN PATENT DOCUMENTS

GB 2208337 A 3/1989
GB 2431702 B 6/2008
GB 2490040 B 7/2014

OTHER PUBLICATIONS

European search report for European Application No. 13186409.2, mailed Feb. 14, 2013.

* cited by examiner

*Primary Examiner* — Gary Paumen
(74) *Attorney, Agent, or Firm* — Lempia Summerfield Katz LLC

(57) ABSTRACT

A connector unit for connecting at least two cables includes a male part, a female part, and a shuttle piston. The shuttle piston includes at least one magnetic connecting device for establishing a magnetic connection between the shuttle piston, and at least one magnetic connecting aid of the male part and at least one latching structure for establishing a force-fitting connection between the shuttle piston and the female part. The male part includes the magnetic connecting aid for interaction with the magnetic connecting device of the shuttle piston for establishing the magnetic connection between the shuttle piston and the male part, and an interaction area for interaction in a force-fitting manner with at least one backing latch of the female part. The female part includes the backing latch for establishing the force-fitting connection and for interacting at least with the interaction area of the male part in a force-fitting manner.

20 Claims, 14 Drawing Sheets

CONNECTOR UNIT

This application claims the benefit of EP 13186409.2, filed on Sep. 27, 2013, which is hereby incorporated by reference in its entirety.

FIELD

The present embodiments relate to a connector unit for connecting at least two cables and methods for establishing or releasing a connection between a male part and a female part of the connector unit.

BACKGROUND

In the near future an increasing demands of communication over wide distances (e.g., between continents) will be needed. Hence, infrastructures, like sea cables and connectors linking sea cables, that are located and operated error proof in harsh environments, like subsea, will be essential. State of the art connectors use for example a male pin and a female socket to enable connection. To mate these parts subsea the male pin must pass through a seal of the female socket without allowing water from the sea into the connector internals. It is known to deploy e.g. a spring loaded shuttle piston that fits intimately with a tip of the male pin (receptacle pin) and is driven back through the seals during the mate. When the connector is demated, the spring maintains contact between the male pin (receptacle) and the shuttle piston thus preventing water transmission through the seal. This solution requires a spring with a significantly high spring rate to prevent accidental compression of the spring. The high spring rate provides that the force significantly increases during the mate. A spring loaded shuttle pin also drives the length of the connector, causing it to be longer than might be possible with alternative ways of keeping water out of the connector.

SUMMARY AND DESCRIPTION

The scope of the present invention is defined solely by the appended claims and is not affected to any degree by the statements within this summary.

The present embodiments may obviate one or more of the drawbacks or limitations in the related art. For example, a connector unit for connecting at least two cables that may be operated with minimum force and may be constructed shorter in length compared to state of the art connectors is provided. The connector unit is reliable and insusceptible to errors.

As another example, methods for establishing or releasing, respectively, a connection between a male part and a female part of the connector unit that provide quick, reliable and unfailing mating and/or demating of the parts of the connector unit are provided.

According to a first aspect, a connector unit for connecting at least two cables (e.g., subsea cables) including at least a male part, a female part and a shuttle piston is provided.

It is proposed, that the shuttle piston includes at least one magnetic connecting device for establishing a magnetic connection between the shuttle piston and at least one magnetic connecting aid of the male part and at least one latching structure for establishing at least a force-fitting connection between the shuttle piston and the female part. Further, the male part includes the magnetic connecting aid for interaction with the magnetic connecting device of the shuttle piston for establishing the magnetic connection between the shuttle piston and the male part and an interaction area for interaction in a force-fitting manner with at least one backing latch of the female part. Moreover, the female part includes the backing latch for establishing the at least force-fitting connection between the shuttle piston and the female part and further for interacting at least with the interaction area of the male part in a force-fitting manner.

A mating and/or demating of the male and female parts of the connector unit can be performed with reduced danger of failure of the connector unit (e.g., by water accidentally entering the connector unit) in comparison of state of the art systems. Thus, a reliable and error proof connector unit may be provided, which offers convincing properties (e.g., for subsea applications). Moreover, mating and demating forces are minimised and occur only during the connecting and/or dis-connecting process. Furthermore, a length of the connector unit is reduced in comparison with known connectors. This is the case because the shuttle piston is no longer driven by the spring, which has to be stored in the mated (compressed) position which typically drives the length of known connectors. In addition, due to the magnetic connection high connecting forces can be provided.

Even if the terms "cable, male part, female part, shuttle piston, magnetic connecting device, magnetic connecting aid, latching structure, interaction area, backing latch, magnetic structure, interaction device, section, region, magnetic section, part, effective surface, magnetic area, base, damping device, flow channel, seal, pin, groove, chamfer, contour and tip" (see also below) are used in the singular or in a specific numeral form in the claims and the specification the scope of the patent (application) should not be restricted to the singular or in the specific numeral form. More than one or a plurality of the above mentioned structure(s) may be provided.

A connector unit may be a unit which physically connects at least two cables (e.g., subsea cables). Thus, the connector unit may be a subsea connector unit. The connector unit may be used in any harsh environment and may be embodied as an electrical connector and/or penetrator or as a wet mateable connector. The connector unit may be employed in a high voltage application. Further, the connector unit could be used in any connector or mechanism where are a high magnetic pull force is required but accidentally picking up ferrous objects would be hazardous.

Furthermore, a female part or socket or plug or connector body may be a part of the unit with an opening, recess or bore to receive another part of the connector unit, like the male part or the shuttle piston or parts thereof. Thus, a male part or receptacle pin may be a part of the unit with a pin, extension or the like to engage or being inserted in the opening of the female part. The female and male parts are intended to establish an electrical connection in case of mating of the male and female part. The female and male parts each may be encased in a casing or an external of a cable. Moreover, the male and female parts may need to be locked together once fully mated for example by a lock or clamp on external metalwork.

Additionally, a shuttle piston or shuttle pin may be a part of the unit that supports, facilitates or mediates the connection between the female and the male part of the unit. Further, the shuttle piston is intended to provide a secure, sealed and in case of an watery environment a leakage free mating of the male and female parts. The shuttle piston includes to sections, a front section and a rear section. They are arranged basically axially in respect of each other, wherein they overlap in their adjacent parts.

The front section is free to move over an outer surface of the rear section. A movement of the front section in relation to the rear section is limited by a front end stop. The front section is pushed forwards from the rear section by a shuttle piston spring so that, when no other forces are acting on the shuttle piston, it rests in its fully extended state. The front section of the shuttle piston is machined out of a single piece of steel so that sea water cannot flow into an oil volume of the piston. This also has the advantage that there is a continuous, smooth surface to ensure that front seals of the female part through which the shuttle piston passes, will maintain a good seal throughout the mate/demate process.

A further feature of the shuttle piston is a small recess in the front of the front section which has a corresponding protrusion from a front of the male part. These features are to aid in the alignment of the two structures. Moreover, the shuttle piston includes a central pin that extends through the front section and guides the magnetic connection device. Furthermore, the shuttle piston includes at least one spring (e.g., a number of springs) that link the magnetic connection device or a magnetic structure (see below) to the shuttle piston or to its rear section, respectively. The spring(s) may be (a) light constant force spring(s) or (a) standard/light coil spring(s). Actually, it has been shown, that standard/light coil springs may be of advantage. Additionally, it may be also possible to use a combination of these spring types.

A magnetic connecting device or a magnetic connecting aid may be a device that establishes a removable connection between the male part and the shuttle piston and/or acts with a magnetic snap fit during the mating/demating. The magnetic connecting device and the magnetic connecting aid are adapted to provide a mechanical latch between the male part and the shuttle piston during movement of the male part relative to the female part.

Moreover, a latching structure or a backing latch may be a device that establishes a removable or releasable connection between the female part and the shuttle piston and/or acts with a mechanical snap fit during the mating/demating or during the connection/dis-connection of the latching aid of the male part with the magnetic connecting device of the shuttle piston, respectively. Thus, the movability of the shuttle piston and the male part may be constructively easy and controllable provided by the backing latch. The wording "at least a force-fitting connection" may be that an additional form-fitting connection between the female part and the shuttle piston may be provided. A combination of a force-fitting connection and a form-fitting connection may be provided.

Further, the backing latch is provided for interaction with the interaction area of the male part and/or the shuttle piston in a force-fitting manner during a movement of the male part relative to the female part. The backing latch may interact with both interaction areas at the same time or first with one and subsequently with the other. In one embodiment, the backing latch interacts first with the interaction area of the shuttle piston and second with that of the male part. The backing latch and/or the latching structure may be any structure feasible for a person skilled in the art, like a pin, a groove, a hook, a frictional or arresting material etc. In one embodiment, the interaction between the interaction area and the backing latch is solely a force-fitting connection that allows however a gliding motion of the backing latch pin on the interaction area.

An interaction area may be an area specifically embodied to provide a (tight and secure) connection or a force-fitting connection between at least the male part and the backing latch of the female part during the movement of the male part relatively to the female part. The specific embodiment may be any embodiment feasible for a person skilled in the art, like a specifically machined or coated surface, a groove or a pin etc. In addition, the shuttle piston may be embodied with a similar or equal interaction area. The backing latch may interact with both interaction areas at the same time or first with one and subsequently with the other. In one embodiment, the backing latch interacts first with the interaction area of the shuttle piston and second with that of the male part.

Hence, the shuttle piston is "latched" onto a front of the male part/receptacle pin during the early stages of the mating process. This provides that the movement of the male part/receptacle pin pushes the shuttle piston back into the female part/connector body and pulls it back out again. The shuttle piston is then "caught" by the backing latch, which prevents the shuttle piston moving further and forces the latch between the male part/receptacle pin and shuttle piston to dis-engage.

Furthermore, it is provided that the magnetic connecting device includes at least one magnetic structure. Due to this, a connection may be facilitated easily. In this context magnetic should be understood as the ability of a structure to react to a magnetic field or the ability of a structure to produce a magnetic field. This structure may be any structure feasible for a person skilled in the art, like a surface, an inner surface of a hole or a pin.

Moreover, the magnetic connecting aid includes at least one interaction device that corresponds to the magnetic structure. Thus, the connection can be established constructively easy and with a minimal amount of pieces. The interaction device is also a magnetic structure and may be any structure feasible for a person skilled in the art, like a surface, an inner surface of a hole or a pin.

It is further provided, that the magnetic structure includes a potted magnet. A single magnet potted in a high permeability material will give the highest binding force between the magnetic connecting device and the magnetic connecting aid. Disadvantageously, a potted magnet may have the greatest range of interaction (or throw) to pick up magnetic debris and dirt. Thus, better results can be obtained by using as an alternative exemplary embodiment of the magnetic structure one that includes a magnet assembly. Magnetic assemblies will have a reduced binding force but the throw of the magnetic field can be greatly reduced. In one embodiment, the magnet assembly includes at least two sections with differently oriented magnetic poles. By using alternate magnetic poles to cancel out the field at larger distances from the assembly the positive effect of a reduced binding force and a minimized throw of the magnetic field can be enhanced. Consequently, the magnet assembly is a multipole magnet. Whether a single potted magnet or a magnet assembly is used will depend on the nature of the use of the latch. A person skilled in the art would select these specifications according to his knowledge in the art.

The sections of the magnetic assembly may be either arranged in radial direction or in axial direction. In one embodiment, more than two sections are used, which were arranged both in radial and in axial direction. In one embodiment, the sections are embodied as concentric rings, for example three, with alternating magnetic orientation or poles in radial direction or axial direction. Moreover, by an arrangement both radially and axially at least two sets of radially concentric rings—arranged in a disk-like fashion—may be arranged axially on after the other.

By providing the interaction device of the magnetic connecting aid in that it includes a high permeability material the unshielded part of the connector unit (male part) is secure from entrapping magnetic debris.

The magnet may be a rare earth magnet. For temperature of up to 200° C. the material may be a Neodymium-Boron-Iron (NdFeB) magnet. If higher temperatures where required a Samarium-Cobalt (SmCo) magnet could be used. The high permeability material may be a Nickel-Iron alloy (commercial examples include Supra50 (50% Nickel:Iron), Invar (36% Nickel, 64% Iron) or Mu-metal (77% Nickel, 16% Iron)). Pure iron could also be used. It is important to note that whatever material is used for the interaction device of the male part or receptacle pin tip it must have been heat treated and annealed post-machining to make it completely magnetically soft; i.e. that it is not magnetisable and its net magnetisation will always return to zero when an external magnetic field is removed. This is to ensure that the interaction device or the tip, respectively, does not become magnetised during operation which would subsequently allow it to attract magnetic debris.

Thus, the magnetic connection or latch operates via an interaction between a magnet or magnet assembly and a mass of high permeability material.

Advantageously, the magnetic structure or the magnet or the magnet assembly, respectively, is arranged axially moveable inside the shuttle piston. Hence, the position of the magnetic structure may be adjusted according to its desired function. The magnetic structure is placed inside the front section and is free to move forwards and backwards, guided by the central pin of the front section. The (light constant force) springs link the magnetic structure and the rear section of the shuttle piston. This is so that when no other forces are acting on the shuttle piston the magnetic structure is in the rear position. This helps to reduce the field at the surface of the shuttle pin to prevent accidental pick-up of magnetic material.

In one embodiment, the shuttle piston includes at least one region out of a high permeability material that is provided to engage a magnetic field of at least one magnetic section of the magnetic structure to reduce the magnetic field of the magnetic section. Hence, the throw of the magnetic field and thus the risk of attracting interfering debris etc. can be advantageously further reduce. The term "engage" should be understood as "shield, interact with, block and/or neutralize". The shielding out of the high permeability material reduces a fringe field of the magnetic section as the field emerging from the front of the magnetic structure will preferentially be drawn into the shielding material rather than looping out far from the magnetic structure.

The action of the high permeability material is useful when the magnetic section is in the rear, unmated position. Thus, the high permeability may be seen as a magnetic shielding for the magnetic section in the unmated assembly. During the mating the high permeability material is then removed to ensure the maximum possible binding force between the male part (magnetic connecting aid) and the shuttle piston.

It is further provided, that the region out of a high permeability material is at least one part of a pin insertable through a hole of the magnetic structure (magnet and/or the magnet assembly). By this embodiment and arrangement the shielding is most efficient. Moreover the region can be easily put into action. The part of the pin may be a specifically selected surface of the pin, like a special layer (coating) out of a high permeability material or a core or the whole pin may be machined out of a high permeability material. The pin is mounted into the shuttle piston front section so that, as the front section is pushed backwards relative to the magnetic section, the (core) pin is removed from the magnetic section.

Alternatively and/or additionally the region is a shell arrangeable at least partially around a circumference of the magnetic structure (magnet and/or the magnet assembly). Due to this, a large area of the magnetic structure which emits a magnetic field can be shielded efficiently when needed. In one embodiment, the shell is arranged concentric around the magnetic section and is arrangeable around the whole circumference of the magnetic structure. The shell may extend along a whole axial length of the magnetic structure or only along parts thereof. The outer shell is mounted on the rear section of the shuttle piston so that, as the magnetic structure moves forwards relative to the rear section, the shell is removed from the magnetic section.

In an embodiment, the magnet assembly includes at least one effective surface and/or wherein the effective surface includes at least two magnetic areas providing equal amounts of magnetic force, wherein the magnetic forces have contrariwise magnetic orientations. In other words, the effective surface of the magnet assembly is half north and half south or the effective surface has an equal area of north and south or the total surface area of north and south poles on the effective surface must be equal.

By ensuring that the total areas of the exposed north and south poles are equal all magnetic flux that emerges from the effective surface of the magnet assembly is linked to an opposing pole on the same face of the magnet assembly. This improved flux linkage will increase a reactive force for a highly permeable material, e.g. the interaction device of the male part, close to the effective surface by ensure that a linkage paths only pass through highly permeable material. It will also improve the field fall off as the field generated by each magnetic area or magnet, respectively, is opposed and cancelled by the field of its neighbours. This increases the short-range attractive force of the magnet assembly while greatly reducing the range of the magnetic field.

In this context an effective surface may be a summation of all exposed surfaces of the magnet assembly that emit a magnetic field. That may be a front, a back and the sides of the assembly. In one embodiment, it is just the front surface of the magnet assembly. Moreover, the effective surface may even vary according to the position of the magnet assembly. In case the magnet assembly is in its rear position the magnetic field of the side surface is engaged by the high permeability material of the core pin and the shell, for example. Thus, only the front contributes to the effective surface. Furthermore, the more magnetic areas or poles, respectively, are placed on the face of the magnetic assembly the greater the reduction in throw and at the cost of reducing the achievable binding force.

To provide a axial shielding (e.g., in a direction facing away of the male part), the magnetic assembly is placed on at least a base out of a high permeability material. The high permeability base will stop any field from being projected behind the magnetic structure and will also increase the attractive force achievable by the magnetic structure.

According to a further embodiment, the magnetic structure includes at least one hydraulic damping device (e.g., at least one flow channel for a lubricant) to limit a movement speed of the magnetic structure. This reduces the risks of fracturing the magnetic structure by mechanical shock consequently failure of the magnetic structure may be minimized. To adjust a needed amount of damping a size of the flow channel may be selected accordingly. A person skilled in the art would select these specifications according to his knowledge in the art.

In a further embodiment, the shuttle piston includes at least one dirt seal that is mounted in an opening or bore of the shuttle piston to prevent entering of dirt, like sediment and grit, into the shuttle piston. The dirt seal is to prevent magnetic material from entering the opening where it could interact with the magnetic field. Hence, the proper function of the magnetic connection will be ensured and may help to make certain that the latch continues to operate (e.g., in dirty water). The dirt seal is a rubber ring driven forwards by a light spring. An opening may be a recess, bore, clearance, blind hole or the like to accommodate a section of the male part. The section may pass through the opening or rest in the opening. In this context, a section of the male part may be a pin, an extension a protrusion or a part thereof to engage or being inserted in the opening of the shuttle piston.

In a further embodiment, the backing latch includes at least one spring loaded pin (latch pin) that is arranged basically radial in respect to an axis of the female part. Thus, a reliable and space saving construction may be obtained. Furthermore, the latching/delatching force of the backing latch can be selected easily by choosing a suitable spring force. In the scope of an arrangement of the pin as "basically radial" to an axis of the female part should also lie a divergence of the strictly radial arrangement of about 30°. In one embodiment, the pin is oriented radial (90°) or perpendicular to the axis of the female part. Generally, the axis of the shuttle piston and that of the male and female part as well is arranged parallel to a direction of movement of the male part. In one embodiment, the pin extends into the opening at a mantel surface of the opening.

It is further provided, that the backing latch includes a plurality of spring loaded pins. Due to this a homogeneous latching/delatching may be achieved. Further, more pins providing a greater redundancy while increasing complexity. The pins may be arranged in any pattern suitable for a person in the art, like randomly or evenly distributed along an inner circumference of the female part (mantel surface of an opening of the female part) or an inner circumference of an assembly holder for the pins, respectively. By this arrangement forces acting on the shuttle piston are constant over the circumference resulting in missing pressure peaks at the shuttle piston thus conserving the construction and material of the shuttle piston.

In one embodiment, the latching structure of the shuttle piston is embodied as at least one groove that extends in circumferential direction of the shuttle piston. Due to this the latching structure can be constructed easily. In one embodiment, the spring loaded pin of the female part is intended to latch with the groove of the shuttle piston, wherein the pin(s) hold(s) the groove and thus the shuttle piston in an axially fixed position. Moreover, by intending the groove to accommodate the spring loaded pin(s) in a force-fitting and basically form-fitting manner, the connection is robust and axially fixed. Hence, a strong and stationary connection can be provided locking the shuttle piston securely in place during the mating or demating of the male part. The term accommodate may be receive and/or hold. In this context the wording "in a basically form-fitting manner" may be that contours of the groove and the pin correspond in shape to each other by at least 30% (e.g., by at least 50%).

To construct the backing latch assembly each backing latch pin is inserted into a hole in the assembly holder, providing a channel guiding the pin, and a spring is placed into a recess behind the pin. The spring and pin are secured in place by a latch pin spring base, which is screwed into a thread in the holder. The base is also used to ensure that the correct compression is applied to the spring. A stepped flange at the bottom of the hole prevents the backing latch pin(s) from moving too far into the bore. At least one lubricating device, like an oil flow channel, may be provided for feeding a lubricant, like oil, to at least one contact surface between the spring loaded pin and the channel guiding the pin. This may prevent hydraulic locking of the backing latch pin(s).

In an embodiment, the backing latch includes at least one chamfer, intended to support either the dis-engagement or the locking of the connection between the shuttle piston and the female part. In case of the dis-engagement the chamfer has a gentle dis-engagement angle. Thus, dis-engagement force of the backing latch can be selected easily by choosing a suitable chamfer. Due to a gentle angle a friction between parts during the demating can be reduced and thus the force needed for the demating is minimised. In this context, gentle may be an angle with a value between 175° and 100°, between 165° and 120°, between 155° and 130° or of 150° with respect to the axis of the female part. The value of the angle can be tuned in this region during design of the backing latch so the required demate force is achieved. The chamfer provides an inclined plane, thus a pushing movement of the male part into the bore of the female part is easy and does initiate the actuation of the pin (compression of the backing spring).

In general could be said, that the force required to disengage each backing latch pin can be controlled by considering the dis-engagement chamfer angle and the stiffness and compression of the backing spring. Larger dis-engagement forces can be gained by increasing the chamfer angle and using a stiffer spring under greater compression.

The chamfer for locking has a vertical or over vertical locking angle. A vertical or over vertical angle may be an angle with a value between 90° and 135°, between 95° and 120°, between 95° and 120° or of 100° with respect to the axis of the female part. This chamfer could also be seen as an anti-extrusion chamfer because by using the vertical or over vertical angle the shuttle piston cannot extrude from the connector body (female part) without shearing the backing latch pin(s).

Moreover, the groove of the shuttle piston has a contour basically designed correspondingly to a contour of the spring loaded pin of the backing latch. Hence, the groove of the shuttle piston has the same profile as the backing latch pin to ensure a smooth engagement and dis-engagement. According to a further construction detail the shuttle piston includes a lip that is, viewed in moving direction of the male part during connecting process, located adjacent to the groove. This lip is recessed slightly in radial direction towards the axis of the shuttle piston so that the lip does not interfere with any of the other features within the connector body, e.g. internal stress control mouldings, a multilam in the contact copper work of the female socket, seals or the like, during the insertion or withdrawal of the shuttle piston and the male part.

In an embodiment, the spring loaded pin of the backing latch includes at least one rounded tip or point. Hence a smooth connecting surface maybe provided. In one embodiment, the shuttle piston or the male part or both include(s) at least one planar surface, wherein the rounded tip of the spring loaded pin is intended to engage the planar surface in a force-fitting manner. Consequently, the backing latch pin(s) will not catch on the interface between the receptacle pin (male part) and the shuttle piston. In one embodiment, the planar surface may be the interaction area of the male part and of the shuttle piston.

According to a further aspect, a method for establishing a connection between a male part and a female part of a connector unit by a shuttle piston of the connector unit is presented.

The method includes: Pushing or moving at least a magnetic connecting aid (pin) of the male part against a moveable part (front section) of the shuttle piston till at least a magnetic connection between the shuttle piston and the male part is established by a magnetic mechanism (via a magnetic connecting device) of the shuttle piston, thereby providing a fixed connection between the shuttle piston and the male part, wherein the shuttle piston is locally fixed in at least a force-fitting manner (e.g., additionally, a form-fitting manner) at the female part by a backing latch of the female part during the connection of the magnetic connecting aid of the male part and a magnetic connecting device the shuttle piston; Moving the male part with the connected shuttle piston (in a moving direction) relative to the female part and thereby unlatching at least the force-fitting connection (e.g., and the additional form-fitting connection between the female part and the shuttle piston (via the backing latch)) until the female part connects at least the shuttle piston (or the male part) in a force-fitting manner (by the backing latch), thereby providing a fixed connection between the male part and the female part.

A mating of the male and female parts of the connector unit can be performed with reduced danger of water accidentally entering the connector unit in comparison of state of the art systems. Moreover, due to minimised mating forces the connecting/latching process can be performed easily.

The pushing or moving of the section of the male part may be performed, for example, against a pressure of a spring, wherein the spring loads the dirt seal to prevent dirt entering the opening of the shuttle piston.

According to a further aspect, a method for releasing a connection between a male part and a female part of a connector unit by a shuttle piston of the connector unit is presented.

It is proposed, that the method includes at least the following steps: Moving the male part with the connected shuttle piston (against a moving direction) relative to the female part till at least a force-fitting connection (e.g., and a form-fitting connection) between the shuttle piston and the female part is established by a backing latch of the female part, thereby providing a fixed connection between the shuttle piston and the female part, wherein the male part is locally fixed in at least a magnetic manner with the shuttle piston by a magnetic mechanism (magnetic connecting device) of the shuttle piston during the movement of the male part relative to the female part; Moving (pulling) the male part (against the moving direction) relative to the shuttle piston (and female part) till at least the magnetic connection between the shuttle piston and the male part established by the magnetic mechanism (via magnetic connecting device) of the shuttle piston is dis-connected, thereby dis-connecting the male part from the female part.

A demating of the male and female parts of the connector unit can be performed with reduced danger of water accidentally entering the connector unit in comparison of state of the art systems. Moreover, due to minimised demating forces the dis-connecting/unlatching process can be performed easily.

After dis-connecting the magnetic mechanism of the male part and the shuttle piston the male part is removed from the shuttle piston and if a dirt seal is provided, it is pushed against the moving direction by the preloaded spring, wherein the seal prevents dirt entering the opening of the shuttle piston.

One or more of the present embodiments relate to a shuttle piston with the above described characteristics for a use is the connector unit and methods. Thus, a connection between the male part and the female part may be most efficiently supported resulting in a smooth and reliable mating and/or demating process.

The above-described characteristics, features and advantages, and the manner in which they are achieved are clear and clearly understood in connection with the following description of exemplary embodiments which are explained in connection with the drawings.

DETAILED DESCRIPTION

Figure 1:
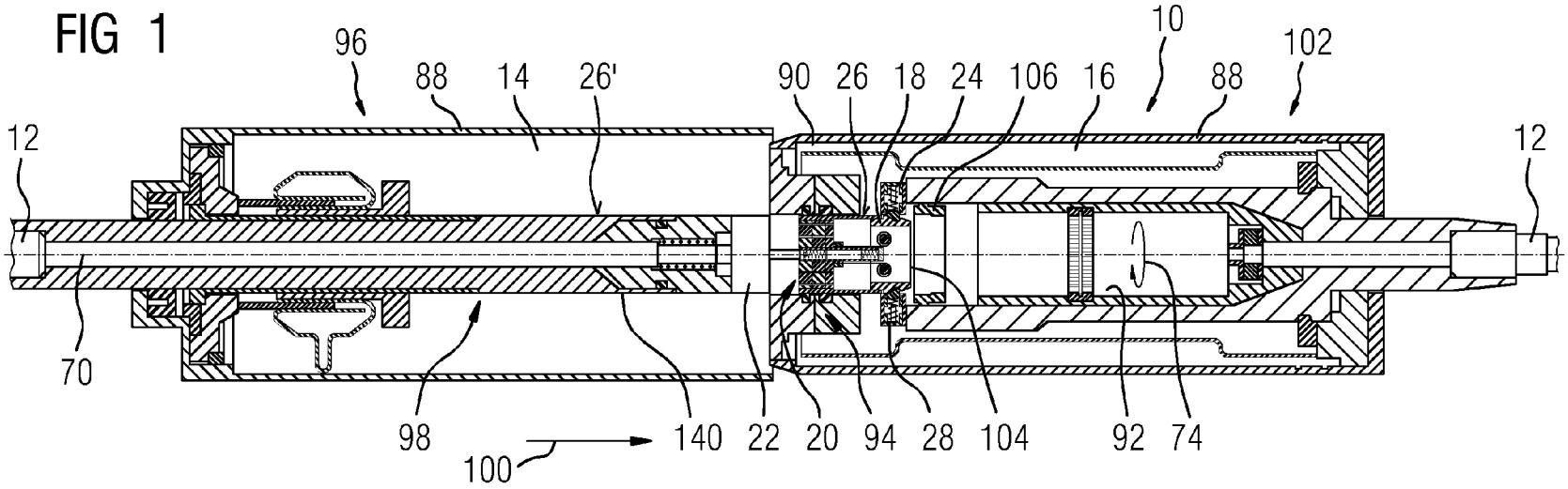
FIG. 1: shows schematically a subsea connector unit with a male part, a female part and a shuttle piston beforehand of mating.

The illustrations in the drawings are schematically. It is noted that in different figures, similar or identical elements are provided with the same reference signs.

FIG. 1 shows an embodiment of a high voltage subsea connector unit 10 for connecting two subsea cables 12, wherein the connector unit 10 includes a male part 14 and a female part 16 (of the cables 12 only connecting regions are illustrated). Both the male part 14 and the female part 16 are each encased in a housing 88, which will be axially aligned during a mating or demating process of the male and female parts 14, 16. The female part 16 is located at a plug front end 90 of one subsea cable 12 and includes an axially extending bore 92 with seals 94 for preventing entering of water or dirt into internals of the female part 16. The male part 14 is located at a receptacle front end 96 of the other subsea cable 12 and includes a receptacle pin assembly 98.

Figure 2:
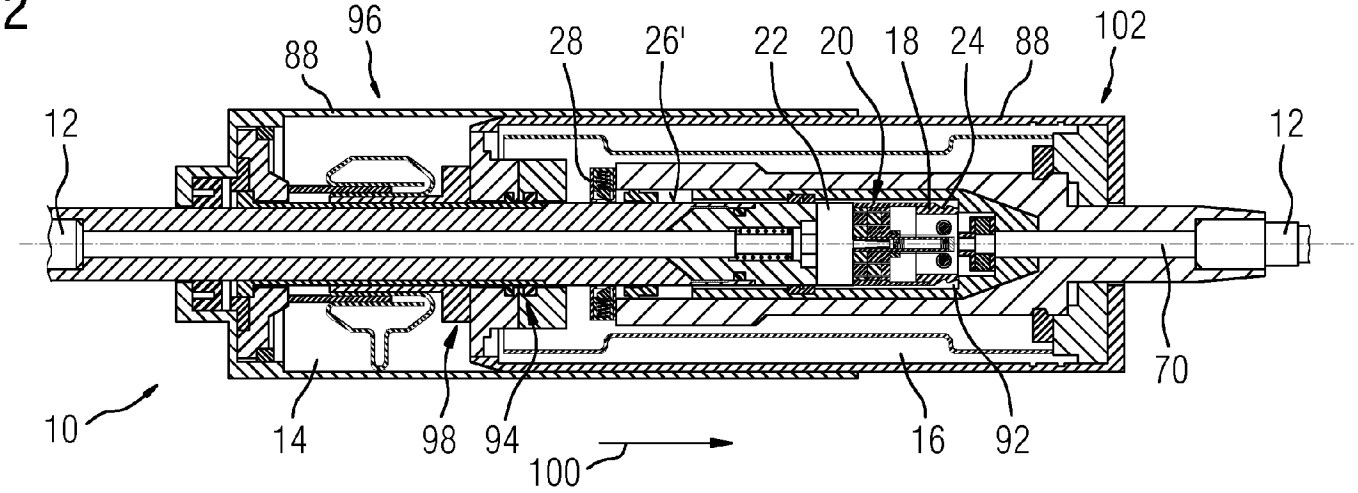
FIG. 2: shows schematically the subsea connector unit from FIG. 1 in a mated position.

For a mating of the male and female parts 14, 16 the bore 92 and the receptacle pin assembly 98 will be arranged vertically aligned towards each other, so that by moving the receptacle pin assembly 98 in direction of the female part 16, in the following text named moving direction 100, the receptacle pin assembly 98 can partially enter the bore 92 of the female part 16. Due to a proper positioning of the receptacle pin assembly 98 in the bore 90 of the female part 16 an electrical connection is established. This mating position is schematically shown in FIG. 2.

The connector unit 10 further includes shuttle piston 18 to support the connection between the female and the male parts 14, 16. Moreover, the shuttle piston 18 is designed to keep water out of the female part 16 of the high voltage subsea connector unit 10. The shuttle piston 18 is inserted into a front end 102 of the bore 92 of the plug front end 90 and connected via a shuttle piston plug 104 with internals 106 of the female part 14 (see FIGS. 1 and 10). In the unmated position a front of the shuttle piston 18 is flush with the front of the electrically female part 14. To secure the shuttle piston 18 axially inside the bore 92 the female part 16 includes a backing latch 28 for establishing a force-fitting and form-fitting connection between the shuttle piston 18 and the female part 16 (details see below).

FIGS. 3 to 7 show an assembly holder 108 of the backing latch 28 in various views. The assembly holder 108 is constructed as an annular structure that extends, when mounted in the female part 16, in circumferential direction 74 of the bore 92 of the female part 16 (FIG. 1). The backing latch 28 includes a plurality of spring loaded pins 68, which are arranged evenly distributed along a circumference 52 of the assembly holder 108.

Figure 3:
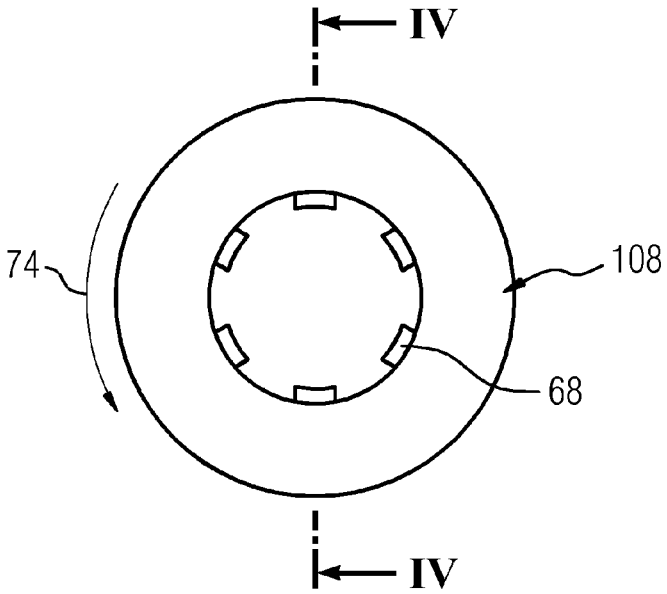
FIG. 3: shows a front view of an assembly holder of a backing latch of the female part from FIG. 1, FIG. 4: shows a section along line IV-IV through the assembly holder from FIG. 3, FIG. 5: shows the assembly holder from FIG. 3 in a first three dimensional view.
Figure 4:
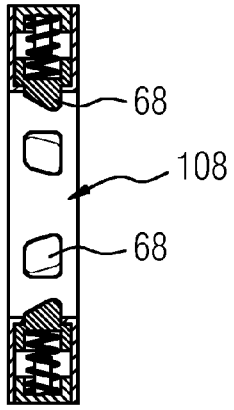
Figure 5:
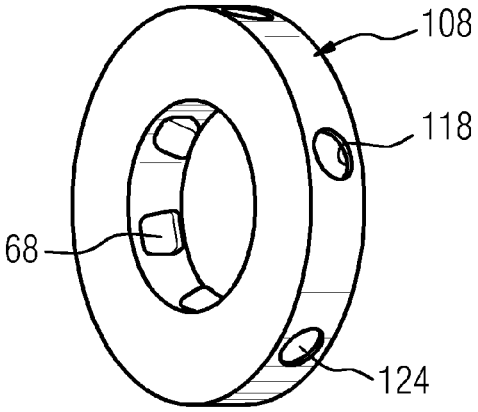
Figure 6:
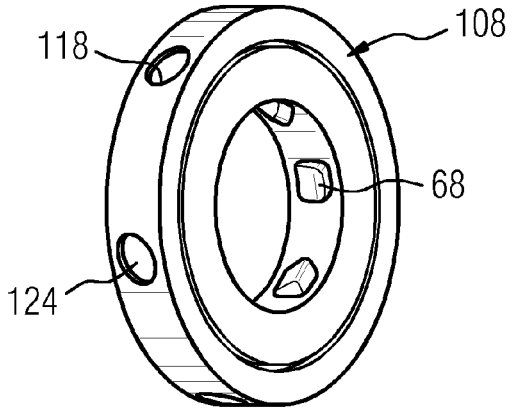
FIG. 6: shows the assembly holder from FIG. 3 in a second three dimensional view.
Figure 7:
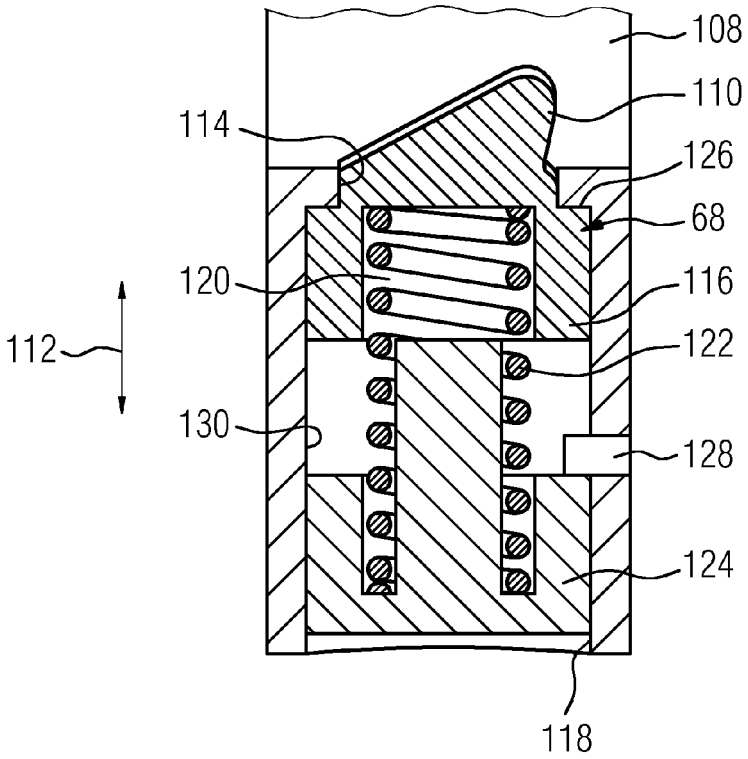
FIG. 7: shows a detailed view of the section through the assembly holder from FIG. 4, FIG. 8: shows a section through a pin of the backing latch from FIG. 3, FIG. 9: shows the pin from FIG. 8 in a three dimensional view.

As could be seen in FIG. 7 that shows a section through a lower part of the assembly holder 108 along line IV-IV in FIG. 3 each spring loaded pin 68 is arranged in its mounted state in the female part 16 basically radial in respect to an axis 70 of the female part 16 (see FIG. 1). A radially inner end 110 of the pin 68 extends in radial direction 112 through a clearance 114 of the assembly holder 108. A radially outer end 116 of the pin 68 extends in a channel 118, guiding the pin 68, and features a recess 120 to accommodate a spring 122 to bias the pin 68.

To construct the assembly each backing latch pin 68 is inserted into the channel 118 in the assembly holder 108 and the spring 122 is placed into the recess 118 behind the inner end 110. The spring 122 and pin 68 are secured in place by a latch pin spring base 124 which is screwed into a thread (not shown in detail) in the holder 108. The base 124 is also used to ensure that the correct compression is applied to the spring 122. A stepped flange 126 at a radially inner bottom of the channel 118 prevents the pin 68 from moving too far into the bore 92 of the female part 16. The backing latch 28 or the assembly holder 108 respectively, includes a lubricating device 128 in the form of an oil flow channel 128 for feeding a lubricant to a contact surface 130 between the spring loaded pin 68 and the channel 118 guiding the spring loaded pin 68 to prevent hydraulic locking of the pins 68.

Figure 8:
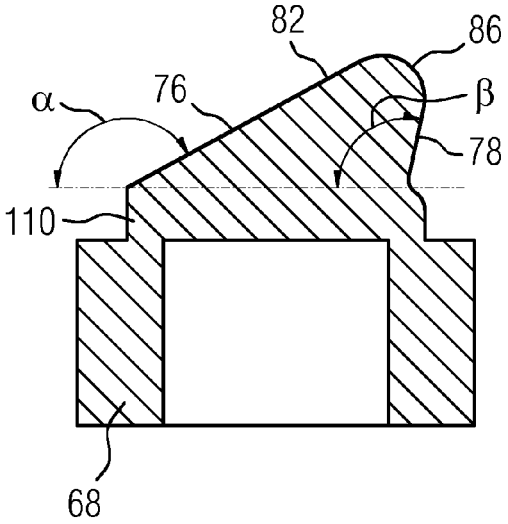

In FIG. 8 a section through a pin 68 is shown. The pin 68 of the backing latch 28 includes two chamfers 76, 78 with angles $\alpha$, $\beta$ which are specifically selected for functions of the chamfers 76, 78. The angle $\alpha$ of chamfer 76 is a gentle dis-engagement angle with an inclination angle of about 150° in respect to the axis 70 of the female part 16 (see FIG. 1). The angle $\beta$ of chamfer 78 is a vertical or over-vertical anti-extrusion angle with an inclination angle of about 100° in respect to the axis 70 of the female part 16. In a mounted state of the assembly holder 108 at the female part 16 the chamfer 76 for dis-engagement faces towards the male part 14 and the chamfer 78 for locking faces in contrariwise direction. The function of the chamfers 76, 78 is to allow a mating and a demating of the shuttle piston 18 from the female part 16 (details see below). Thus, the backing latch 28 of the female part 16 provides a releasable connection between the shuttle piston 18 and the female part 16. In addition, the backing latch 28 is further needed to prevent the shuttle piston 18 from extruding out of the female part 16 (against the moving direction 100) and to provide a resistive force to enable the male part 14 to be dis-connected at the end of the demating process (see below).

The force required to dis-engage each pin 68 can be controlled by considering the dis-engagement chamfer angle $\alpha$ and the stiffness and compression of the backing spring 122. Larger dis-engagement forces can be gained by increasing the chamfer angle $\alpha$ and using a stiffer spring 122 under greater compression. Using this design the shuttle piston cannot extrude from the female part 14 without shearing the backing latch pins 68.

Figure 9:
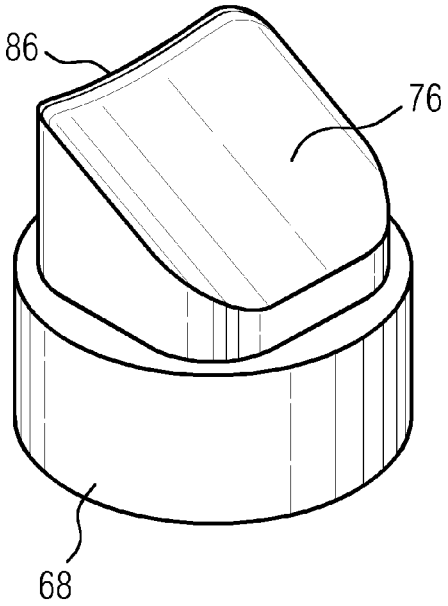

Further, the spring loaded pin 68 of the backing latch 28 or the radially inner end 110, respectively, includes a rounded tip 86 so that the pin 68 will not catch on interfaces 132, 132' between two sections 134, 136 of the shuttle piston 18 and between the male part 14 and the shuttle piston 18 (see below). FIG. 9 shows the pin 68 in a three dimensional view.

Figure 10:
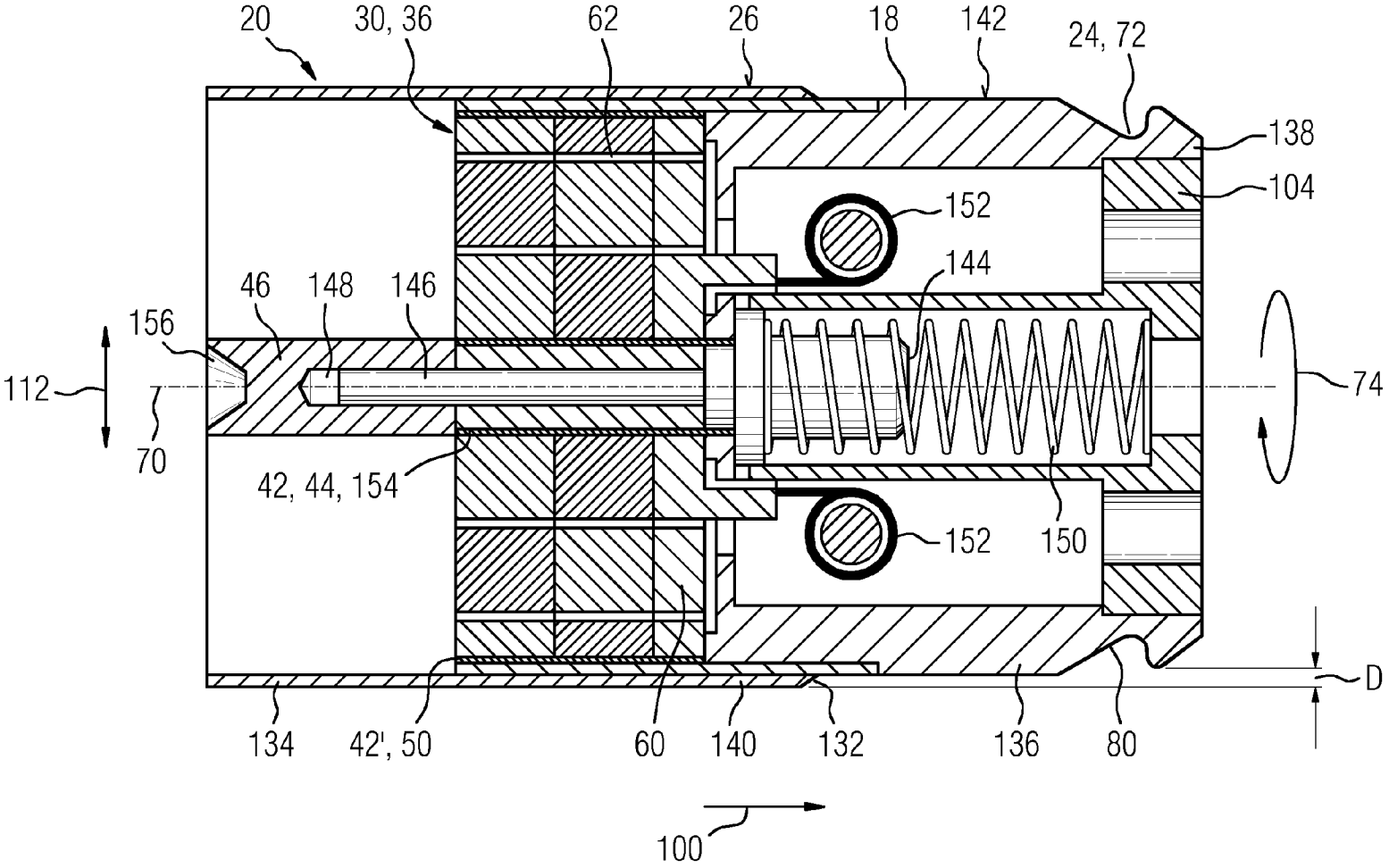
FIG. 10: shows the shuttle piston from FIG. 1 with a magnetic connecting device and a latching structure.

FIG. 10 shows the shuttle piston 18 in a sectional view. For interaction with the backing latch 28 of the female part 16 the shuttle piston 18 includes a latching structure 24 for establishing the force-fitting and form-fitting connection between the shuttle piston 18 and the female part 16. This latching structure 24 is embodied as a groove 72 extending in circumferential direction 74 of the shuttle piston 18. In the mated position of the shuttle piston 18 and the female part 16 the spring loaded pins 68 of the female part 16 are latched with the groove 72 of the shuttle piston 18 (see FIG. 1).

Therefore, the groove 72 has a contour 80 that is basically designed correspondingly to a contour 82 (chamfers 76, 78) of the spring loaded pin 68 of the backing latch 28 (see FIG. 8). In other words, the groove 72 has the same profile as a latch pin 68 to ensure a smooth engagement and dis-engagement. An end of the shuttle piston 18 in direction to the female part 16 and located adjacent to the groove 72 features a lip 138 that is radially recessed slightly about distance D so that the lip 138 does not interfere with any of the other features, like internal stress control mouldings or a multilam in a female socket contact, within the female part 16.

Figure 21:
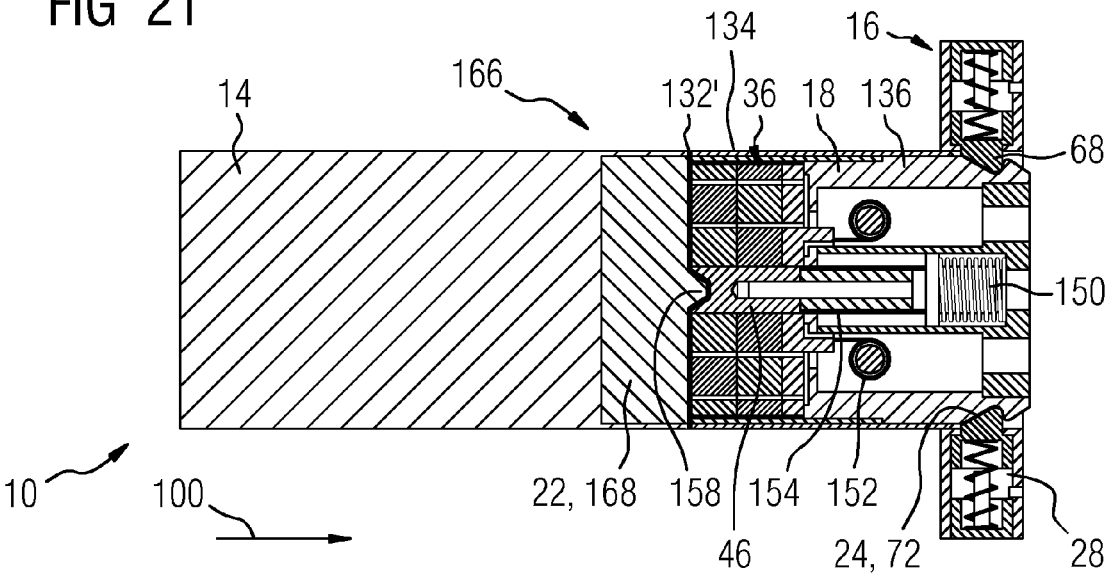
FIG. 21: shows schematically the male part with the connected shuttle piston after mating.

Both the shuttle piston 18 and the male part 14 have an interaction area 26, 26' for interaction in a force-fitting manner with the backing latch 28 of the female part 16. The interaction areas 26, 26' are embodied as planar surfaces 26, 26' at a radially outer cylinder barrel 140 of the male part 14 and the shuttle piston 18. After connection of a magnetic connecting aid 22 of the male part 14 (see below) with the shuttle piston 18 the cylinder barrels 140 of both pieces end radially flush with each other. Hence, the transition between the planar surface 26 of the shuttle piston 18 and the planar surface 26' of the male part 14 build the smooth interface 132' (see below and FIG. 21).

Figure 22:
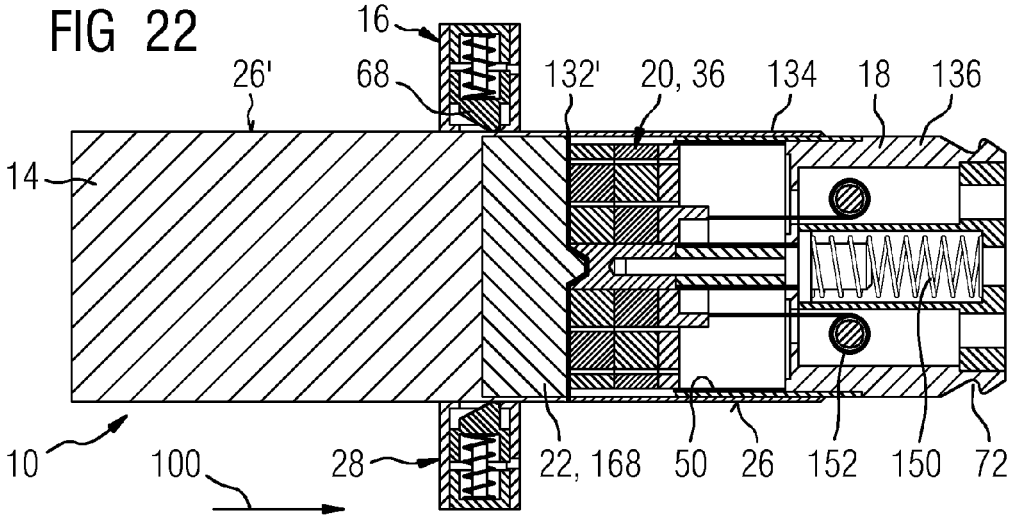
FIG. 22: shows schematically the male part with the connected shuttle piston after mating and dis-engagement from the female part in a first demating scenario.
Figure 23:
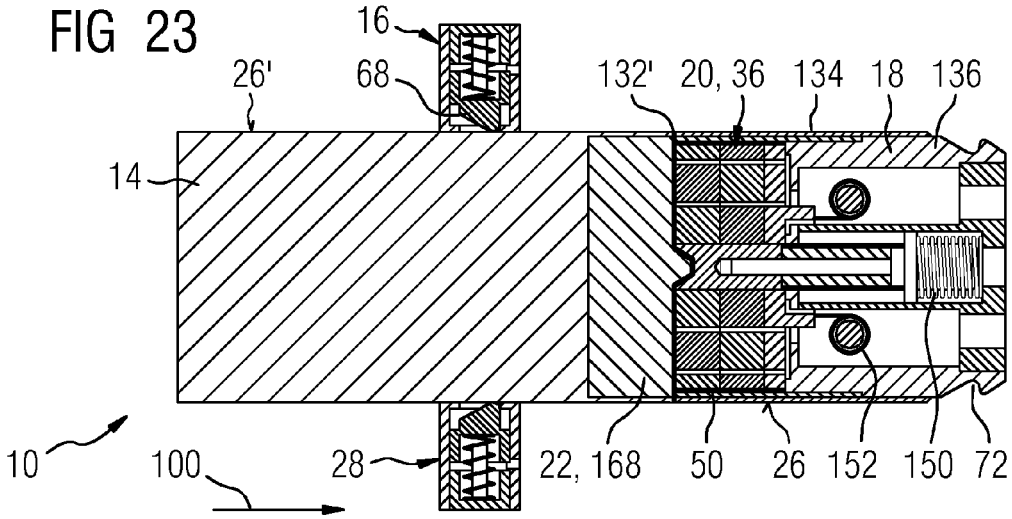
FIG. 23: shows schematically the male part with the connected shuttle piston after mating and dis-engagement from the female part in a second demating scenario.

After dis-engagement of the backing latch pins 68 from the groove 72 the rounded tip 86 of the spring loaded pin 68 first engages the planar surface 26 of the shuttle piston 18 in a force-fitting manner and as the male part 14 is further moved in moving direction 100 into the female part 16 the rounded tip 86 engages the planar surface 26' of the male part 14 in a force-fitting manner (see FIGS. 22 and 23). The force-fitting connection between the tip 86 of the backing latch pin 68 and the interaction areas or planar surfaces 26, 26' of the shuttle piston 18 and the male part 14, respectively, is embodied in such a way that a gliding motion of the tip 86 on the planar surface 26, 26' is allowed or easily possible. The force-fitting connection is latching action.

The principal of operation for the backing latch is that in the normal, unmated, position, the shuttle piston 18 is prevented from moving easily by the latch pins 68 being engaged in the shuttle piston groove 72. Extrusion beyond the female part 16 would be impossible without shearing all of the latch pins 68. To mate the male and female parts 14, 16 a large enough force must be applied so the pins 68 will be pushed clear by the dis-engagement chamfer angle $\alpha$. Once fully mated the backing latch 24 will not interfere with male part 14 or shuttle piston 18 movements as they will be fully recessed (see below). During the demate process the pins 68 will be pushed into the shuttle piston groove 72, locking the shuttle piston 18 into the original position.

Figure 11:
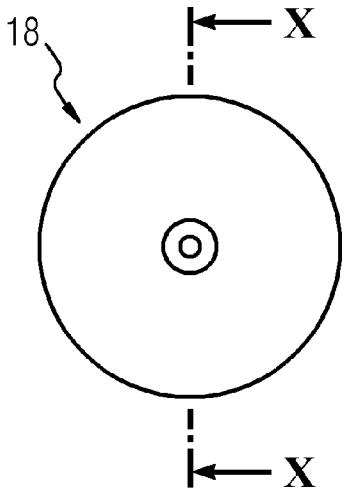
FIG. 11: shows a front view of the shuttle piston from FIG. 10, FIG. 12: shows a side view of the shuttle piston from FIG. 10, FIG. 13: shows the shuttle piston from FIG. 10 in a three dimensional view.
Figure 12:
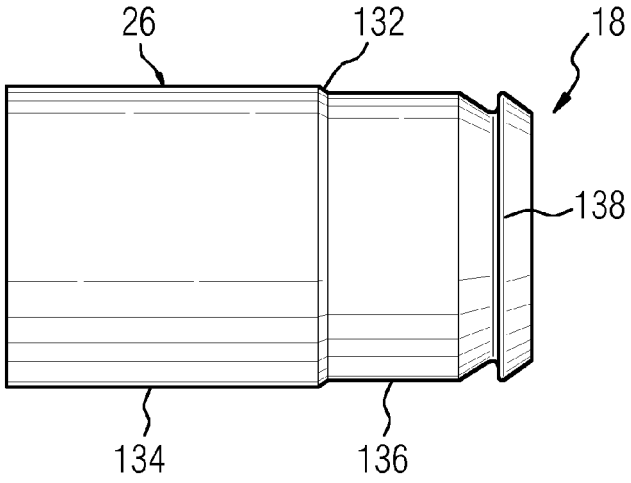
Figure 13:
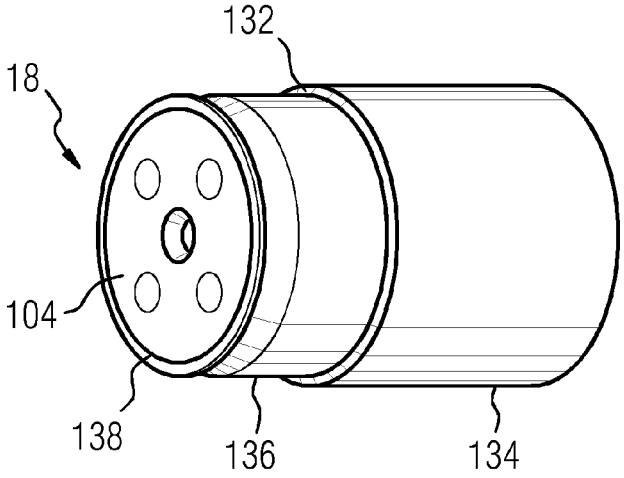

As stated above, the shuttle piston 18 includes the two sections 134, 136, namely a front section 134 and a rear section 136. They are arranged basically axially in respect of each other, wherein they overlap in their adjacent parts. The front section 134 is free to move over an outer surface 142 of the rear section 136. A movement of the front section 134 in relation to the rear section 136 is limited by a front end stop 144 mounted in the rear section 136 and extending with a protrusion 146 in a recess 148 of a central pin 46 of the front section 134. The front section 134 is pushed forwards from the rear section 136 by a shuttle piston spring 150 loading the front end stop 144 so that, when no other forces are acting on the shuttle piston 18, it rests in its fully extended state. FIGS. 11 to 13 show the shuttle piston 18 in various views, wherein the line X-X in FIG. 11 depicts the cut for the sectional view of FIG. 10.

To join the male part 14 and the shuttle piston 18 during the mating and demating processes, the shuttle piston 18 includes a magnetic connecting device 20 for establishing a magnetic connection between the shuttle piston 18 and the magnetic connecting aid 22 of the male part 14. The magnetic connecting device 20 includes a magnetic structure 30 that is placed inside the front section 134 of the shuttle piston 18 and is arranged axially moveable inside the shuttle piston 18 or the front section, respectively. Thus, the magnetic structure 30 is free to move forwards and backwards, guided by the central pin 46 of the front section 134. There are a number of light constant force springs 152 which link the magnetic structure 30 and the rear section 136 of the shuttle piston 18. This is so that when no other forces are acting on the shuttle piston 18 the magnetic structure 30 is in the rear position. This helps to reduce the field at a front surface of the shuttle piston 18 to prevent accidental pick-up of magnetic material. Alternatively, it would be possible to us light compression springs (not shown).

Figure 16:
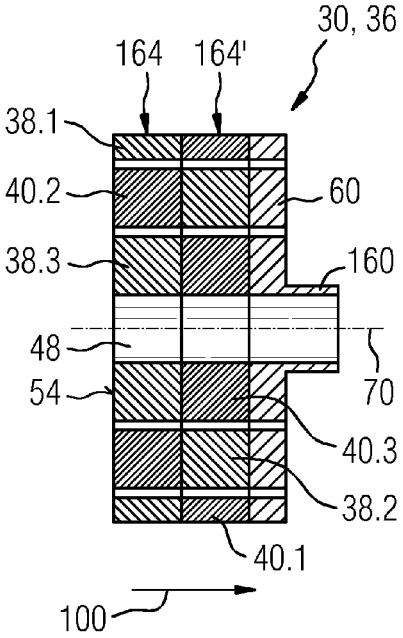

To further shield the magnetic structure 30 or its magnetic field, respectively, and thus to reduce the throw of the magnetic field when the magnetic structure 30 is in the rear, unmated position, the shuttle piston 18 includes two regions 42, 42' out of a high permeability material that is provided to engage a magnetic field of magnetic sections 38.1, 38.2, 38.3, 40.1, 40.2, 40.3 of the magnetic structure 30 to reduce the magnetic field of the magnetic sections 38.1, 38.2, 38.3, 40.1, 40.2, 40.3, (see FIG. 16).

Figure 15:
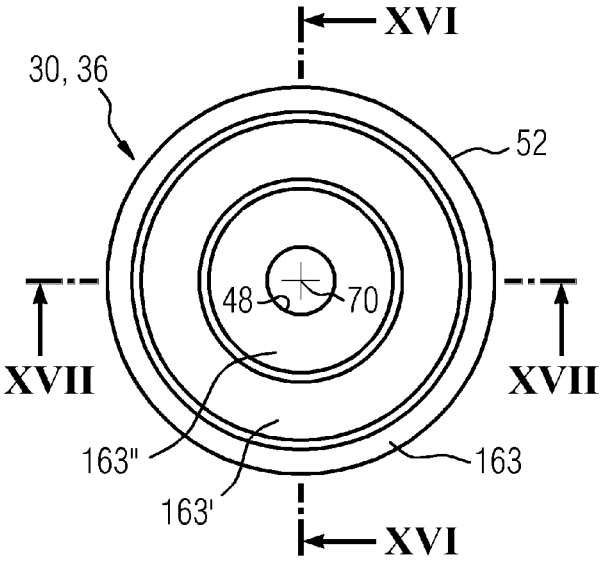

Region 42 is a part 44, e.g. a radially outer layer 154 of the pin 46 that is, when the magnetic structure 30 is in the rear position, inserted in a hole 48 of the magnetic structure 30 (see FIGS. 15 and 16). Furthermore, region 42' is a shell 50 that is when the magnetic structure 30 is in the rear position arranged around a circumference 52 of the magnetic structure 30 (see FIG. 15). Since the core pin 46 is mounted into the shuttle piston front section 134 so that, as the front section 134 is pushed backwards relative to the magnetic structure 30, the core pin 46 is removed from the magnetic structure 30. The outer shell 50 is mounted on the rear section 136 so that, as the magnetic section 30 moves forwards relative to the rear section 136, the shell 50 is removed from the magnetic section 30 (details see below).

It should be noted that the high permeability pin 46 or core and shell 50 are may be omitted. These would only be included if extra magnetic shielding was required.

In addition, the shuttle piston 18 includes the small recess 156 at a front of the pin 46. This recess 156 has a corresponding protrusion 158 from the front of the male part 14 (see FIG. 14). These features are to aid in the alignment of the shuttle piston 18 and the male part 14.

Figure 17:
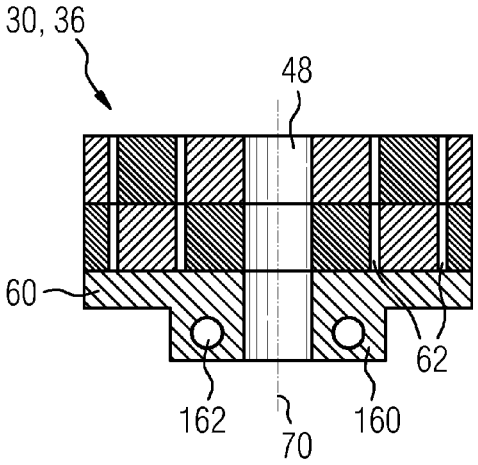
Figure 18:
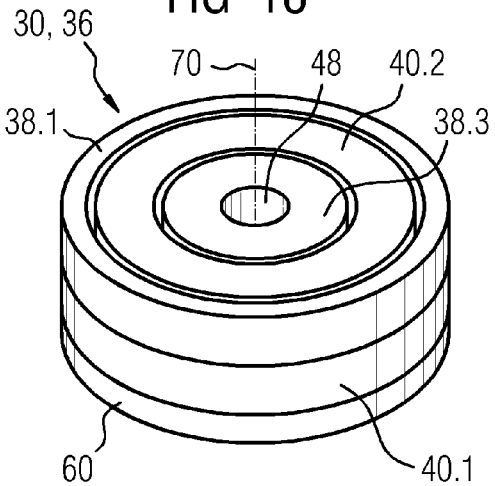

The magnetic structure 30 is embodied as a magnet assembly 36 that is shown in FIGS. 15 to 18 in various views, wherein FIG. 16 shows a section of the magnet assembly 36 from FIG. 15 along line XVI-XVI, FIG. 17 along line XVII-XVII through and FIG. 18 shows a three dimensional view. The magnet assembly 36 is placed on a base 60 out of a high permeability material to shield a region located in moving direction 100 after the magnet assembly 36 from the magnetic field of the magnet assembly 36 (see FIG. 1). The base 60 includes an axially extending flange 160 which engages into the rear section 136 of the shuttle piston 18. For connection with the rear section 136 the flange has two holes 162 in which the light constant force springs 152 engage (see FIG. 17). Moreover, the magnetic structure 30 includes a hydraulic damping device 62 in the form of several flow channels 62 for a lubricant, like oil, to limit a movement speed of the magnetic structure 30.

The magnet assembly 36 includes three rings 163, 163', 163", wherein each ring 163, 163', 163" has two sections 38.1, 40.1; 38.2, 40.2; 38.3, 40.3. The rings 163, 163', 163" are arranged concentric towards each other and towards the axis 70. Sections 40.1, 38.2, 40.3 build a first set 164 and sections 38.1, 40.2, 38.3 build a second set 164', wherein the sets 164, 164' are fashioned in a disc-like manner. The second set 164' is views in moving direction 100 arranged axially after the first set 164. The concentric rings 163, 163', 163" have alternating magnetic orientations or poles, wherein the orientation pattern of the sections 40.1, 38.2, 40.3 of the first set 164 is vice versa to the orientation pattern of the sections 38.1, 40.2, 38.3 of the second set 164'.

Thus, the magnet assembly 36 includes several sections 38.1, 38.2, 38.3, 40.1, 40.2, 40.3 with differently oriented magnetic poles (e.g. sections with 38 are north poles; sections with 40 are south poles). The three magnetic rings 163, 163', 163" are arranged so that the exposed face of each magnetic section 38.1, 40.2, 38.3, 40.1, 38.2, 40.3 is opposed to its neighbours. This increases the short-range attractive force of the magnet assembly 36 while greatly reducing the range of the magnetic field.

Figure 14:
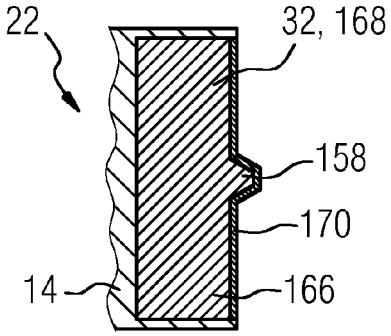
FIG. 14: shows section through a magnetic connecting aid of the male part from FIG. 1, FIG. 15: shows a top view of a magnet assembly of the magnetic connection device from FIG. 10, FIG. 16: shows a section along line XVI-XVI through the magnet assembly from FIG. 15, FIG. 17: shows a section along line XVII-XVII through the magnet assembly from FIG. 15, FIG. 18: shows the magnet assembly from FIG. 15 in a three dimensional view.

In FIG. 14 a tip 166 of the male part is shown. At the tip 166 the magnetic connecting aid 22 is arranged. It includes an interaction device 32 that corresponds to the magnetic structure 30 or the magnet assembly 36, respectively. The interaction device 32 includes a bulk 168 of high permeability material to provide the connection with the shuttle piston 18. As stated above, this connection is supported by the protrusion 158 at the tip 166 that engages the recess 156 at the front of the pin 46 of the front section 134. Furthermore, the bulk 168 is covered with a corrosion resistant shell 170 to protect it from sea water.

Generally speaking the latch between the male part 14 and the shuttle piston 18 operates via the interaction between the magnet assembly 36 and a mass 168 of high permeability material.

The magnet of the magnetic structure 30 may be a rare earth magnet. For temperature of up to 200° C., the material may be a Neodymium-Boron-Iron (NdFeB) magnet. If higher temperatures where required a Samarium-Cobalt (SmCo) magnet could be used. The high permeability material may be a Nickel-Iron alloy (commercial examples include Supra50 (50% Nickel:Iron), Invar (36% Nickel, 64% Iron) or Mu-metal (77% Nickel, 16% Iron)). Pure iron could also be used. According to an embodiment, the core pin 46, the shell 50, the base and the bulk 168, would be made out of the same high permeability material. In general, it would be also possible to use different materials, which would be selected according to the required properties of the specific part.

Figure 19:
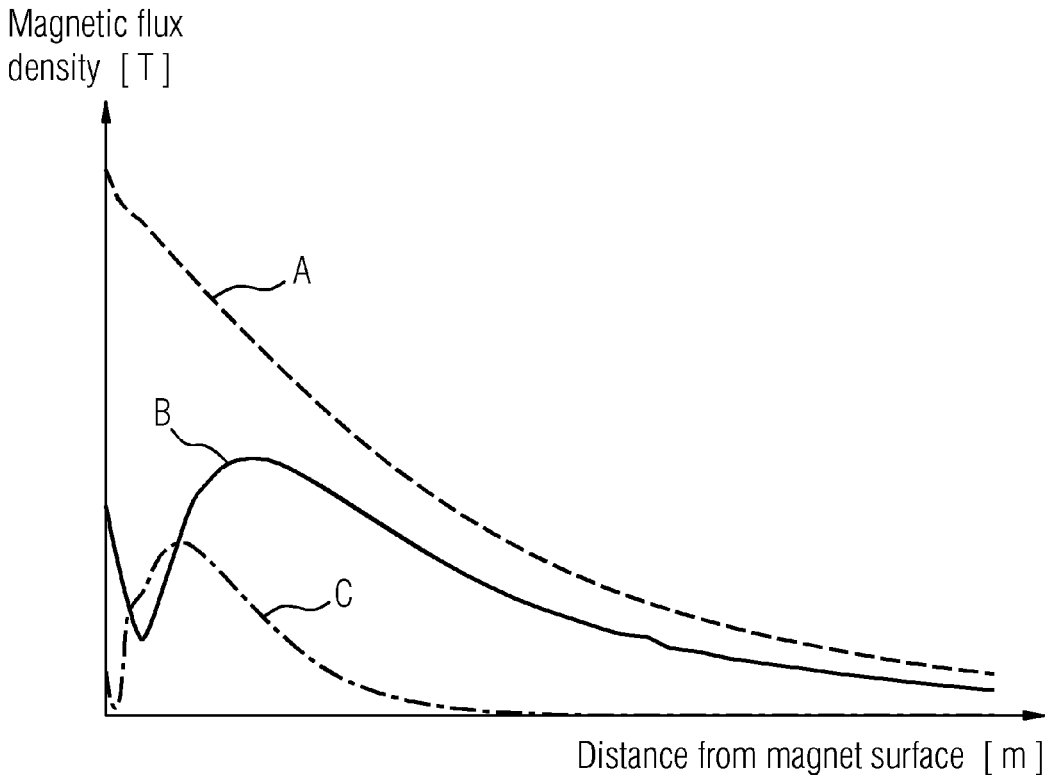
FIG. 19: shows a diagram depicting a predicted axial magnetic field for three different magnet configurations (a bare magnet, a potted magnet and a three magnet assembly)

In FIG. 19 a diagram depicting a predicted axial magnetic field for three different magnet configurations with a same length and diameter is shown. The y-axis refers to the magnetic flux density in Tesla (T) and on the x-axis the distance from the magnet surface in metre (m) is plotted. Graph A represents a bare magnet, graph B a potted magnet 34 (see FIG. 25) and graph C the magnet assembly 36. The graphs A, B, C depict the magnetic field on an axis of each magnet (bare magnet, potted magnet 34, magnet assembly 36).

The bare magnet (graph A) has at its centre its highest magnetic flux density but is significantly weaker in respect to its overall attractive force due to a long flux path length and a weak flux linkage (not depicted). In contrast, the highest magnetic flux density for the potted magnet 34 (graph B) and the magnet assembly 36 (graph C) is not on the axis but at some position further out across a magnetic surface. As could be seen, the potted magnet 34 (graph B) and the three magnet assembly 36 (graph C) have similar attractive forces. Advantageously, as shown in graph C, the field drops off far quicker from a surface 54 of the three magnet assembly 36 (see FIG. 16) in comparison with the potted magnet 34 (graph B) and the bare magnet (A). For example experiments had shown that, even if the binding force of the potted magnet 34 and the magnet assembly 36 are similar, the potted magnet 34 will pick up magnetic material for distances up to ~80-100 millimetre (mm) from the surface of the potted magnet 34 whereas the magnet assembly 36 will only pick up material which is closer than ~17 mm from the surface 54.

Generally, a maximum force of a magnet is dependent on the flux linkage from the north to south pole of the magnet. In case of the potted magnet 34 a return path of magnetic flux lines emerging from a front pole of the magnet to the rear of the magnet is completed through the higher permeability pot In the magnet assembly 36 the flux linkage is improved as the field lines emerging from a front pole of the magnet do not have to loop around to the rear of the magnet assembly 36 at all; the field lines link from one magnetic section 38.1, 38.2, 38.3, 40.1, 40.2, 40.3 to its neighbour (for example from section 38.1 to section 40.2 and from that to section 38.3) and as the north and south areas of the magnetic sections 38.1, 38.2, 38.3, 40.1, 40.2, 40.3 are nearly equal all the magnetic flux lines can link at one end. This will give short path lengths and so increases flux linkage (not shown). Consequently, less magnetic flux lines pass though the attracted object (bulk 168) in comparison to the potted magnet 34. This is represented by the faster fall off of the magnetic field of the magnet assembly 36 (graph C) in comparison to the potted magnet 34 (graph B).

Hence, the magnet assembly 36 has a sufficient magnetic force to attract and bind the high permeability material at a low distance range from the surface 54 of the magnet assembly 36, but the range is sufficient narrow to not attract debris.

On the basis of FIGS. 20 to 24 a method for establishing the connection between the male part 14 and the female part 16 of a connector unit 10 by the shuttle piston 18 as well as a method for releasing the connection between the male part 14 and the female part 16 of a connector unit 10 by the shuttle piston 18 will be explained. The female part 18 is merely represented by the shown assembly holder 108 of the backing latch 28. Moreover, for better presentability the male part 14 is shown without a hatching.

Figure 20:
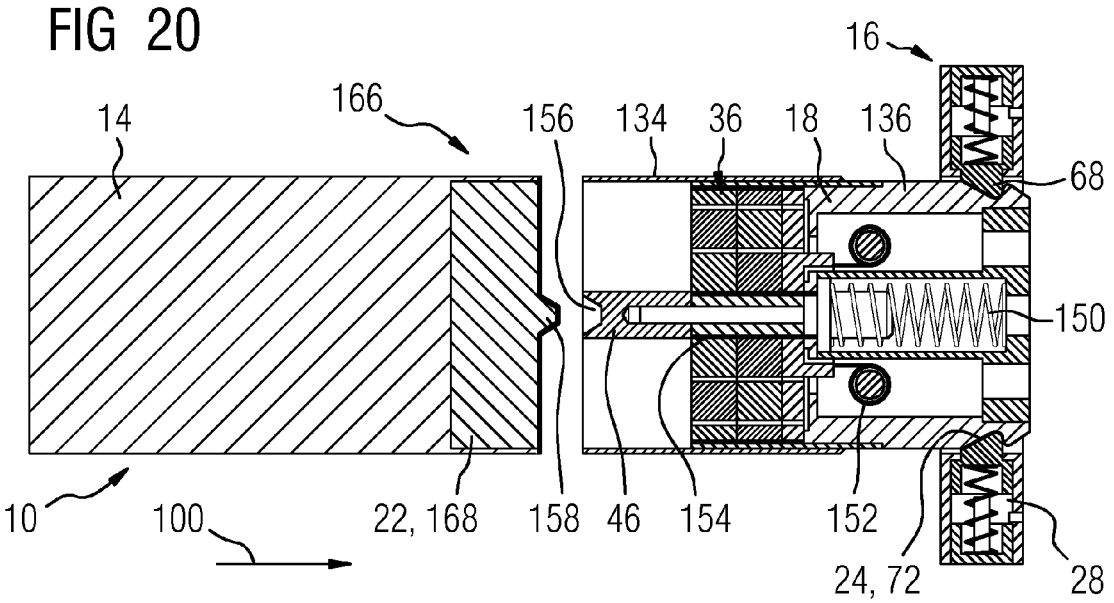
FIG. 20 shows schematically the male part and the shuttle piston connected to the female part beforehand of mating of the male part and the shuttle piston.

FIG. 20 shows the unmated situation of the male part 14 and the shuttle piston 18. In this position the shuttle piston 18 is prevented from moving easily by the backing latch pins 68 being engaged in the shuttle piston groove 72. The front section 134 is prevented from moving easily by the shuttle piston spring 150 and, if it is depressed accidentally, the spring 150 will return it to the forwards resting position. The magnet assembly 36 is held in the rear position by the constant force springs 152, reducing the magnetic field at a surface of the shuttle piston 18. Extrusion beyond the female part 16 (in direction of the male part 14) would be impossible without shearing all of the backing latch pins 68.

The tip 166 of the male part 14 is aligned with the front of the front section 134 of the shuttle piston 18 so that the protrusion 158 engages the recess 156 of the pin 46. By pushing the tip 166 with the magnetic connecting aid 22 in moving direction 100 against the front section 134 of the shuttle piston 18 the front section 134 is pushed back against the shuttle piston spring 150, which will be compressed. Due to the movement of the pin 46 the layer 154 out of high permeability material is removed from the hole 48 of the magnet assembly 36. This ensures the maximum possible binding force between the male part 14 and shuttle piston 18.

The male part 14 is moved till the magnetic connection between the shuttle piston 18 and the male part 14 is established or the magnet assembly 36 is brought into contact with the high permeability bulk 168. Hence, a fixed connection between the shuttle piston 18 and the male part 14 is provided. To ensure a proper mating during the connection of the magnetic connecting aid 22 and the magnetic connecting device 20 the shuttle piston 18 is locally fixed in a force-fitting and form-fitting manner at the female part 16 by the latched backing latch pins 68 of the female part 16 in the latching structure 24 or groove 72, respectively, of the shuttle piston 18 (see FIG. 21).

In general, it would be also possible that the magnet assembly 36 would be pulled forward (against moving direction 100) by the force of the high permeability material. This would be the cased when the magnetic force is stronger than the retaining force of the constant force spring 152 (not shown).

After the connection of the magnetic connecting device 20 with the magnetic connecting aid 22 the male part 14 with the connected shuttle piston 18 is moved in moving direction 100 relative to the female part 16. A larger force will allow the backing latch pins 68 to dis-engage from the groove 72 and the male part 14 and the shuttle piston 18 can enter the female part 16 securely bound together.

This is supported by the dis-engagement chamfer 76 of the pins 68 and a part of the contour 80 of the groove 72, which are embodied correspondingly in respect towards each other. Hence, the force-fitting and form-fitting connection between the female part 16 and the shuttle piston 18 unlatches. This is possible because the pins 68 are able to retreat into their channels 118 of the assembly holder 108 thereby compressing the spring 122. Consequently, the female part 16 or the rounded tip 86 of each pin 68 connects the planar surface 26 of the shuttle piston 18 in a force-fitting manner. This is also supported by an inclined surface continuing an inclination of the groove 72 of the front section 134 at the interface 132 between the front and rear sections 134, 136 (see FIGS. 10, 12 and 21).

After the delatching of the shuttle piston 18 from the backing latch 28 there are two mating scenarios or configurations of the shuttle piston 18 possible. The difference between the scenarios, which are shown in FIGS. 22 and 23, comes from the balance of forces between the constant force springs 152 and the shuttle piston spring 150.

In the first scenario (FIG. 22) the shuttle piston spring 150 is stronger than the constant force springs 152. Once the restrictive force of the backing latch 28 is removed and as the shuttle piston spring 150 is stronger than the constant force springs 152, the shuttle piston 18 will uncompress. As the shuttle piston 18 uncompresses, as the magnetic assembly 36 and tip 168 of the male part 14 are bound together, the magnet assembly 36 will move out of the shielding material of the shell 50 or will be no longer shielded by the shell 50 of the rear section 136. Due to the removed high permeability material the maximum possible binding force between the male part 14 and shuttle piston 18 is ensured. These actions lead to the situation with an extended shuttle piston 18 with the magnet assembly 36 in the forward position. The shuttle piston 18 will remain in this extended configuration until the shuttle piston 18 re-engages with the backing latch 28 during the demate process (see below).

In the second scenario (FIG. 23) the shuttle piston spring 150 is weaker than the constant force springs 152. As the constant force springs 152 are stronger than the shuttle piston spring 150, the shuttle piston 18 will remain in the compressed, short, configuration. This will result in the magnet assembly 36 remaining within the shielding material of shell 50 while the shuttle piston 18 is in the fully mated compressed position. The shuttle piston 18 will remain compressed until the demate process.

By pushing the male part 14 further into the bore 92 of the female part 16 the rounded tip 86 will cross the interface 132' between the shuttle piston 18 and the male part 14, wherein the rounded tip 86 then connects the planar surface 26' of the male part 14 in a force-fitting manner. Once fully mated there will be no impediment to the movement of the male part 14 and the shuttle piston 18 and so they will remain bound together. As a result of this mating sequence, a fixed connection between the male part 14 and the female part 16 is provided. This situation is shown in FIGS. 22 and 23, which show the connector unit 10 after mating of the male part 14 with the shuttle piston 18 according the two above described mating scenarios and the dis-engagement from the female part 16. To secure the connection between the male part 14 and the female part 16 or lock them further in their fully mated state the connector unit 10 may include a securing device, for example a lock and/or a clamp, provided e.g. on external metalwork (not shown).

To dis-connect the male part 14 from the female part 16 the male part 14 with the connected shuttle piston 18 is moved or pulled against the moving direction 100 relative to the female part 16. The movement of the shuttle piston 18 is stopped by the reengaged latch between the pins 68 of the backing latch 28 and the groove 72 of the shuttle piston 18. This is mediated by the loosening of the spring 122 that pushes the pin 68 back into the groove 72 radially. Further, the locking is supported by the locking chamfer 78 of the pins 68 and a part of the contour 80 of the groove 72, which are embodied correspondingly in respect towards each other. Thus, the force-fitting and form-fitting connection between the shuttle piston 18 and the female part 16 is re-established and thereby providing a fixed connection between the shuttle piston 18 and the female part 16.

As stated above, the male part 14 is locally fixed in a magnetic manner with the shuttle piston 18 by a magnetic mechanism of the shuttle piston 18 during the movement of the male part 14 relative to the female part 16. As stated above the state of the shuttle piston 18 (extended or compressed) differs for the two above described scenarios. Thus, the demating sequence for both scenarios will differ slightly.

Figure 24:
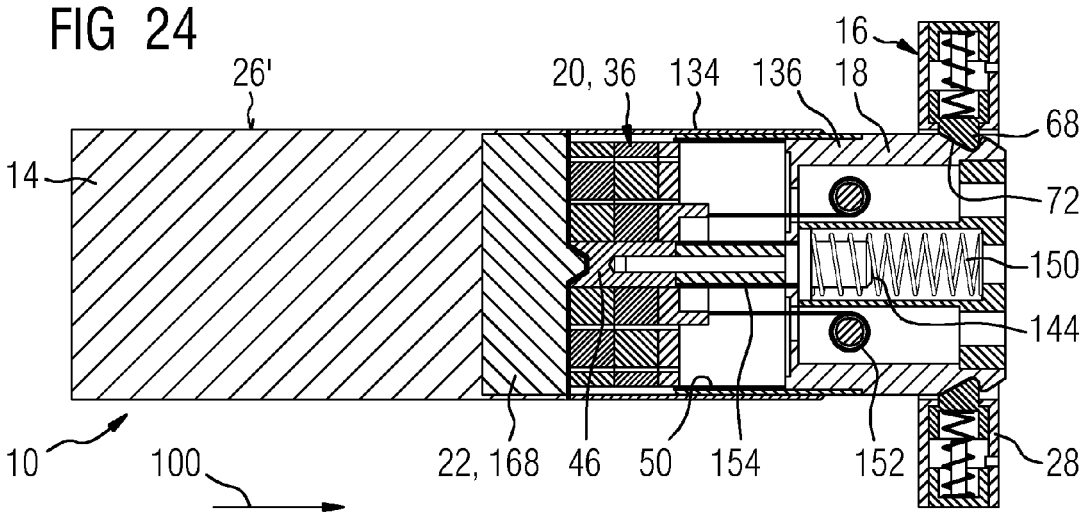
FIG. 24: shows schematically the male part with the connected shuttle piston after relatching with the female part beforehand of a demating of the male part from the shuttle piston.

In the second scenario the shuttle piston 18 is in its compressed configuration. After the re-engagement of the backing latch 28 the male part 14 is further moved or pulled against the moving direction 100 relative to the shuttle piston 18 and thus the female part 16. Consequently, the magnet assembly 36 will be pulled forwards out of the shielding material of shell 50. At the same time the shuttle piston spring 150 would decompress and therewith the shuttle piston 18. This stops when the front end stop 144 engages the rear section 136. This will also prevents the magnet assembly 36 from moving further against moving direction 100. This situation is shown in FIG. 24, which depicts the connector unit 10 after reengagement of the shuttle piston 18 with the female part 16 beforehand of the demating of the male part 14 from the shuttle piston 18. Since the shuttle piston 18 is moved in the first scenario in its uncompressed state, FIG. 24 also depicts the situation of the shuttle piston 18 after engagement with the backing latch 28 according to the first scenario.

To dis-engage the connection between the male part 14 and the shuttle piston 18 the male part 14 is moved or pulled against the moving direction 100 relative to the shuttle piston 18 and thus the female part 16. This will be allowed, as stated above, when the front end stop 144 reaches the shuttle piston rear section 136. When a large force is applied the magnetic connection between the shuttle piston 18 and the male part 14 established by the magnetic mechanism of the shuttle piston 18 can be dis-connected and the male part 14 can be removed. As a result of this demating sequence the male part 14 is disconnected from the shuttle piston 18 or the female part 16, respectively (now shown in detail).

Once the magnet assembly 36 and high permeability material of the male part 14 have been separated the shuttle piston 18 will then be locked into the forward position and the constant force springs 152 will pull the magnet assembly 36 back into the shielding (core pin 46, shell 50). This will return the system to the starting position (see FIG. 20).

FIGS. 25 to 35 show alternative exemplary embodiment of the magnetic structure 30, the shuttle piston 18 and the male part 14. Identical components, features and functions are denoted by the same reference numerals. However, to distinguish the exemplary embodiment of FIGS. 25 to 35 over that of FIGS. 1 to 24 the letters 'a' to 'c' have been added to the reference numerals of the components that are designed differently in the exemplary embodiment of FIGS. 25 to 35. The description below is substantially limited to these differences compared to the exemplary embodiment of FIGS. 1 to 24, wherein reference is made to the description of the exemplary embodiment in FIGS. 1 to 24 with respect to identical components, features, and functions.

Figure 25:
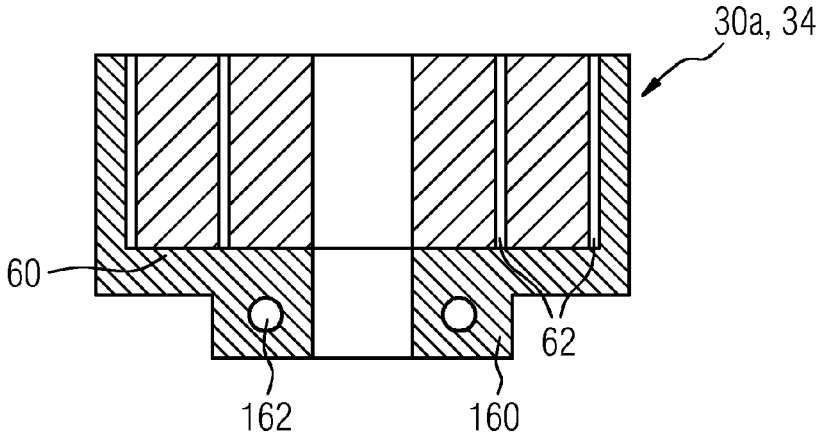
FIG. 25: shows a section through a first alternative magnetic structure in the form of a potted magnet.

FIG. 25 shows a first alternative embodiment of the magnetic structure 30. The magnetic structure 30*a* of FIG. 25 differs from the magnetic structure 30 of FIGS. 15 to 18 in that that the magnetic structure 30*a* includes a potted magnet 34.

Figure 26:
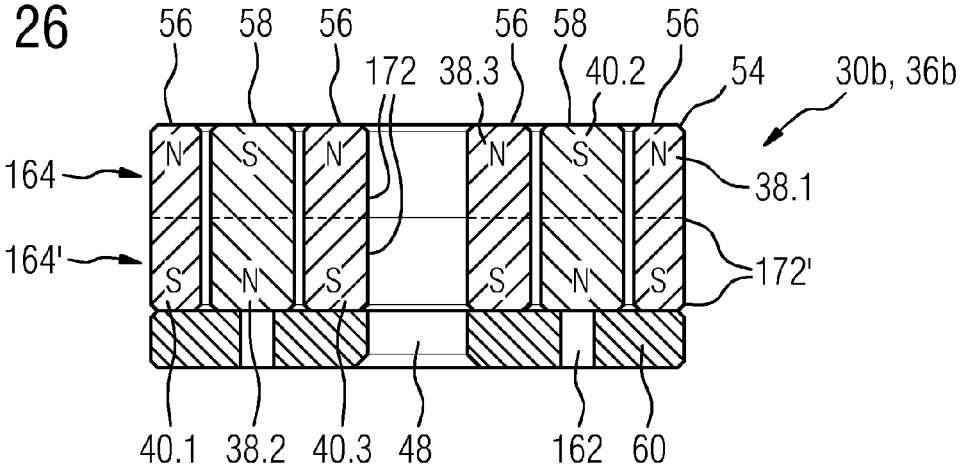
FIG. 26: shows a section through a first alternative magnet assembly.
Figure 27:
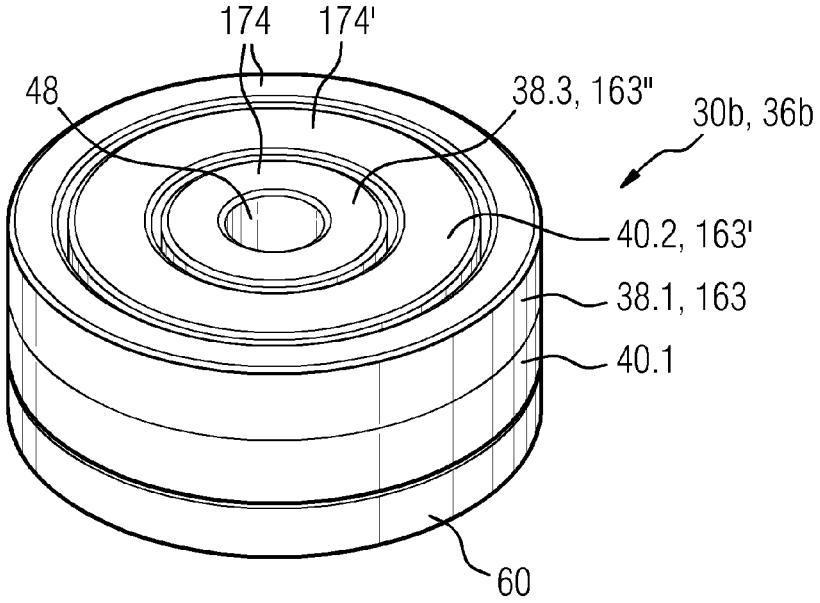
FIG. 27: shows the magnet assembly from FIG. 25 in a three dimensional view.

FIGS. 26 and 27 show a second alternative embodiment of the magnetic structure 30. The magnetic structure 30*b* of FIGS. 26 and 27 differs from the magnetic structure 30 of FIGS. 15 to 18 in that that the magnetic structure 30*b* includes an advanced magnet assembly 36*b*. The magnet assembly 36*b* includes an effective surface 54 that includes two magnetic areas 56, 58 providing equal amounts of magnetic force, wherein the magnetic forces have contrariwise magnetic orientations. In this exemplary embodiment magnetic area 56 includes the sections 38.1, 38.3 that have a north orientation and magnetic area 58 includes section 40.2 that has a south orientation. In other words, the effective surface 54 of the magnet assembly 36*b* is half north and half south.

Even, when the magnet assembly 36*b* is exposed from a high permeability material pin and shell and radially inner and outer surfaces 172, 172' of rings 163, 163', 163" will be exposed the effective surface 54 is unchanged. This is the case, because the magnets are magnetised in axial direction so that magnetic field lines within the magnet are all parallel to a magnet axis. A base 60 of the magnet assembly 36*b* is embodied without an axially extending flange. The base 60 includes holes 162 to connect constant force springs of a shuttle piston (not shown).

As states above, magnetic area 56 (magnetic sections 38.1, 38.3 of rings 163, 163") represents north poles and magnetic area 58 (magnetic section 40.2 of ring 163') is a south pole. If magnetic ring 163" has a hole 48 through the middle with a diameter of 10 mm and magnetic ring 163 has an outer diameter of 54 mm then, in the simplest distribution of areas 56, 58, the magnetic rings 163, 163', 163" geometries are as follows:

| Magnetic ring | Inner diameter (mm) | Outer diameter (mm) | Front face surface area ($mm^2$) |
|---|---|---|---|
| 163 | 47.8 | 54 | 494 |
| 163' | 29 | 45.8 | 988 |
| 163" | 10 | 27 | 494 |

As can be seen, in this exemplary embodiment, magnetic rings 163 and 163" will have an equal front surface area 174 and their areas summed give the surface area 174' of magnet 163'.

However, to reduce the fringe field of the magnetic rings 163, 163', 163" it is better if magnetic ring 163 has an area 174 which is twice that of magnetic ring 163" but the areas 174 of magnetic rings 163 and 163" must still sum to be equal to magnetic ring 163'. In this case the magnet geometries are:

| Magnetic ring | Inner diameter (mm) | Outer diameter (mm) | Front face surface area ($mm^2$) |
|---|---|---|---|
| 163 | 45.5 | 54 | 666 |
| 163' | 24.9 | 43.5 | 999 |
| 163" | 10 | 22.9 | 333 |

Whichever case is used the total surface area 56 of north poles and the total surface area 58 of south poles on the front effective surface 54 must be equal.

In FIGS. 28 to 35 a first alternative embodiment of the male part 14 and the shuttle piston 18 is shown. The male part 14*c* of FIGS. 31 to 35 and the shuttle piston 18*c* of FIGS. 28 to 30 and 32 to 35 differ from the male part 14 of FIGS. 1, 2, 14 and 20 to 25 and the shuttle piston 18 of FIGS. 1, 2, 10 to 13 and 20 to 25 in that that they provide a higher attracting force for triggering a movement of a magnet assembly 36.

Figure 28:
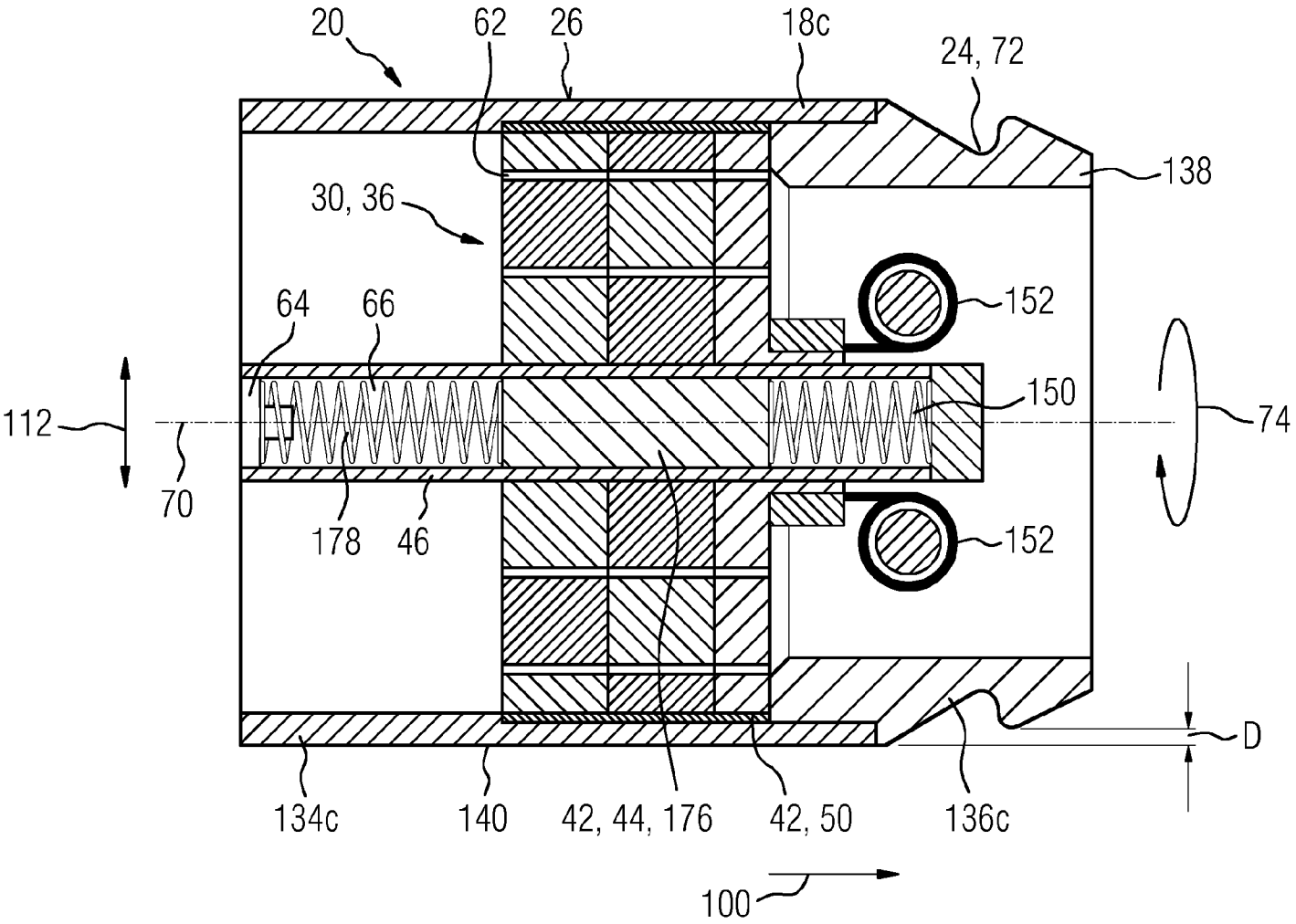
FIG. 28: shows an alternative shuttle piston with a magnetic connecting device, a latching structure and an opening with a dirt seal.
Figure 29:
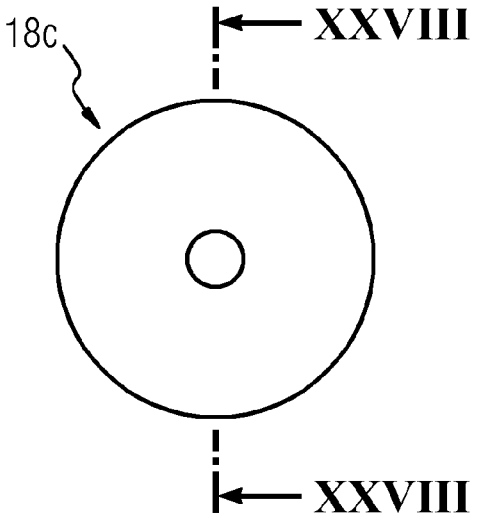
FIG. 29: shows a front view of the shuttle piston from FIG. 28, FIG. 30: shows a side view of the shuttle piston from FIG. 28, FIG. 31: shows a section through a magnetic connecting aid of a male part.
Figure 30:
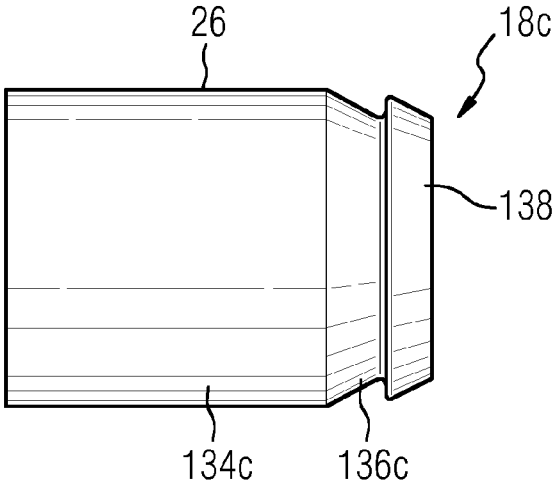

FIG. 28 shows a section through the shuttle piston 18*c* along line XXVIII-XXVIII of FIG. 29 that shows a front view of the shuttle piston 18*c*, wherein FIG. 30 depicts a side view of the shuttle piston 18*c*. The shuttle piston 18*c* includes a front section 134*c* embodied as a cylinder barrel 140 and a rear section 136*c* featuring a groove 72 of a latching structure 24 to establish a releasable connection with a female part 16 of a connecting unit 10 (see FIG. 32). Moreover, the rear section 136*c* includes a central pin 46 axially extending into the cylinder barrel 140 and guiding a magnet assembly 36, which is connected to the rear section 136*c* by light constant force springs 152.

The pin 46 includes region 42 out of a high permeability material, wherein this part 44 is an axially moveable core 176 of the pin 46. The core 176 is in a normal, unmated configuration of the shuttle piston 18*c* biased by a spring 150, 178 on either of its sides. Spring 150 is arranged between the core 176 and a stop of the pin 46 at the rear of the shuttle piston 18*c*. The spring 178 is a dirt seal spring and is arranged between a dirt seal 64 and the core 176. The dirt seal 64 is mounted in a central opening 66 at the front end of the pin 46 and is used to prevent entering of dirt or magnetic material into the shuttle piston 18*c*, where it could interact with the magnetic field and the high permeability core 176 to reduce the throw of the magnetic field when the connector unit 10 is unmated.

Figure 31:
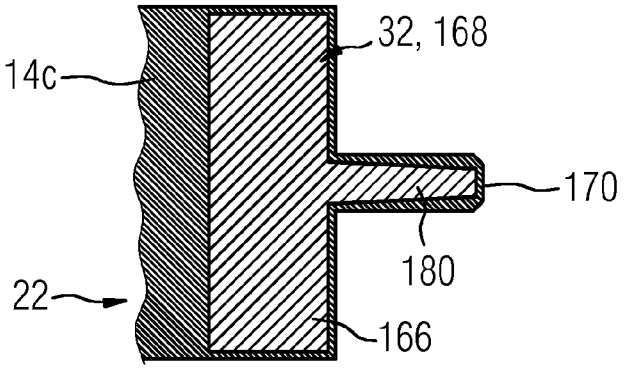

FIG. 31 shows the corresponding male part 14*c*. A bulk 168 of a high permeability material at a tip 166 of the male part 14*c* includes a finger 180 out of a high permeability material. The finger 180 extends axially and is tapered. Moreover, to achieve a homogeneous thickness in vertical direction the tapered part of the finger 180 as well as a front includes a corrosion resistant shell 170. The purpose of the finger 180 is so that it can enter the opening 66 of the shuttle piston 18*c* and interact with the stronger magnetic field or to create a high magnetic pull drawing the magnet assembly 36 forwards, out of the shielding (shell 50, core 176), to bind with large mass or bulk 168 of high permeability material.

On the basis of FIGS. 32 to 35 a mating and demating sequence of the male part 14*c* and the female part 16 of the connector unit 10 by the shuttle piston 18*c* will be explained. The female part 18 is merely represented by the shown assembly holder 108 of the backing latch 28. Moreover, for better presentability the male part 14 is shown without a hatching.

Figure 32:
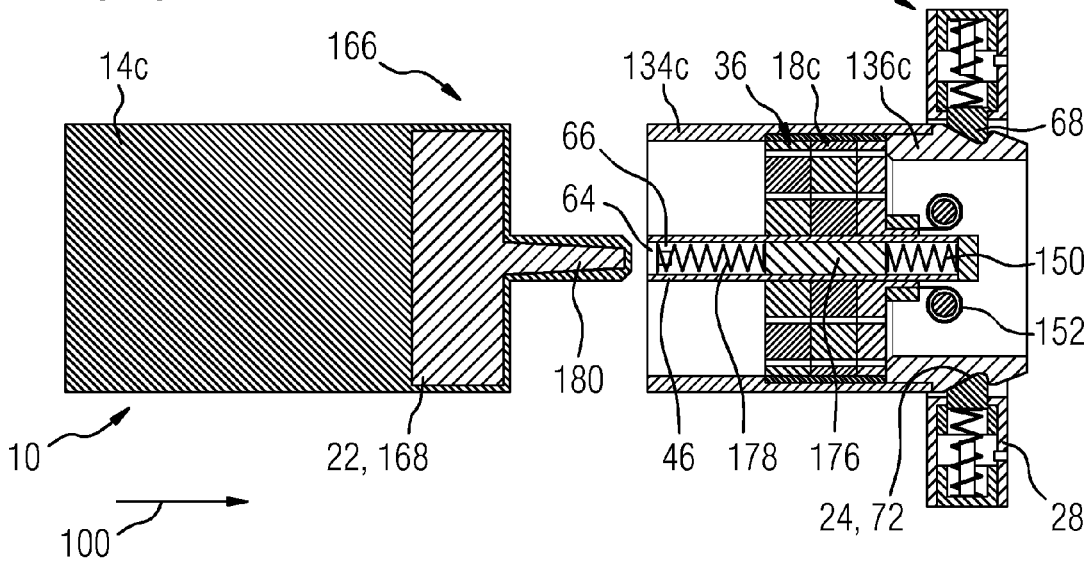
FIG. 32: shows schematically a male part with the magnetic connecting aid from FIG. 31 and the shuttle piston from FIG. 28 connected to a female part beforehand of mating of the male part and the shuttle piston.

FIG. 32 shows the unmated situation of the male part 14*c* and the shuttle piston 18*c*. In this position the shuttle piston 18*c* is prevented from moving easily by the backing latch pins 68 being engaged in the shuttle piston groove 72. The magnet assembly 36 is held in the rear position by the constant force springs 152, reducing the magnetic field at a surface of the shuttle piston 18. The dirt seal 64 is held in the forwards position preventing magnetic debris from entering the opening 66 of the shuttle piston 18*c* where it may interact with the stronger magnetic field. Extrusion beyond the female part 16 (in direction of the male part 14*c*) would be impossible without shearing all of the backing latch pins 68.

Figure 33:
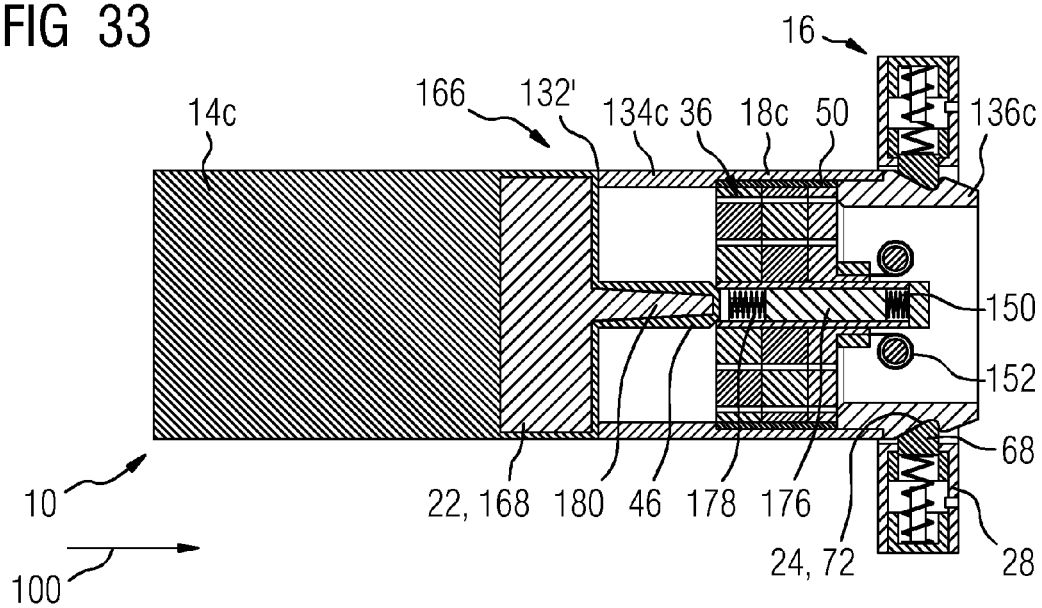
FIG. 33: shows schematically the male part with the connected shuttle piston after mating.

As the male part 14*c* begins the mate the finger 180 enters the shuttle piston opening 66, pushing the dirt seal 64 and the high permeability core 176 backwards thereby compressing both springs 150, 178 (see FIG. 33). Here the finger 180 will interact with the magnetic field and the resulting force will pull the magnet assembly 36 forwards against the constant force springs 152 as well as against moving direction 100 and out of a shell 50 out of a high permeability material as well as away from the high permeability core 176. Once at the front of the shuttle piston 18*c* the magnet assembly 36 will pull to the large bulk 168 of high permeability material, binding the male part 14*c* and the shuttle piston 18*c* together (see magnet assembly 36 arrangement in FIG. 34).

Figure 34:
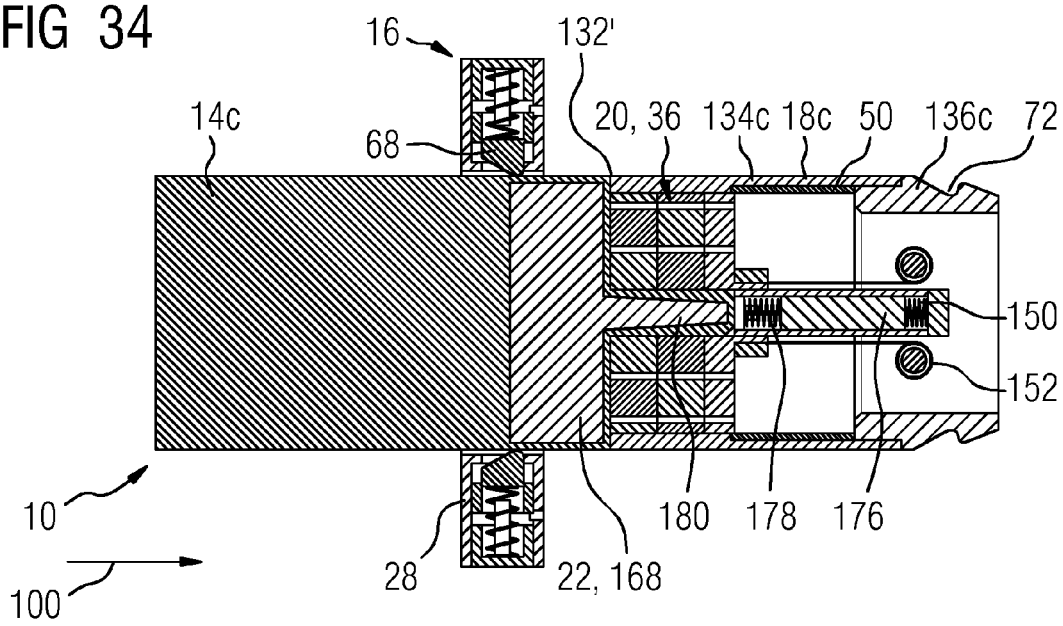
FIG. 34: shows schematically the male part with the connected shuttle piston after mating and dis-engagement from the female part.
Figure 35:
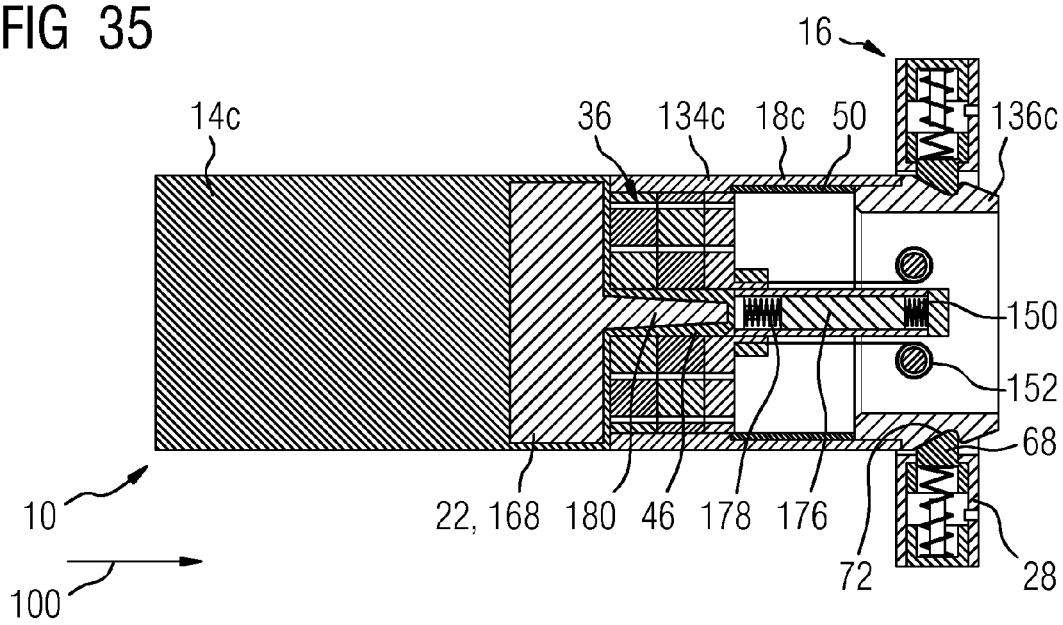
FIG. 35: shows schematically the male part with the connected shuttle piston after relatching with the female part beforehand of a demating of the male part from the shuttle piston.

A larger force in moving direction 100 will allow the backing latch 28 to disengage and the male part 14*c* with the shuttle piston 18*c* can enter the female part 16 securely bound together. Once fully mated there will be no impediment to the movement of the male part 14*c* with the shuttle piston 18*c* and so they will remain bound together. This situation is shown in FIG. 34.

During the demate process the backing latch 24 will reengage, stopping the forward movement of the shuttle piston 18*c*. A large force against moving direction 100 can then be applied to disengage the magnet assembly 36 and remove the male part 14*c*. The shuttle piston 18*c* will then be locked into the forward position and the magnet assembly 36 will move backwards, propelled by the constant force springs 152. The dirt seal 64 and high permeability core 176 will move forwards due to the decompression of springs 150, 178 returning the system to the starting position.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Although the invention is illustrated and described in detail by the embodiments, the invention is not limited by the examples disclosed, and other variations may be derived therefrom by a person skilled in the art without departing from the scope of the invention.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A connector unit comprising:

a male part;

a female part; and a shuttle piston, wherein the shuttle piston comprises at least one magnetic connecting device operable to establish a magnetic connection between the shuttle piston and at least one magnetic connecting aid of the male part; and at least one latching structure operable to establish at least a force-fitting connection between the shuttle piston and the female part, wherein the male part comprises:

the at least one magnetic connecting aid for interaction with the magnetic connecting device of the shuttle piston for establishing the magnetic connection between the shuttle piston and the male part; and an interaction area for interaction in a force-fitting manner with at least one backing latch of the female part, and wherein the female part comprises:

the at least one backing latch operable to establish the at least force-fitting connection between the shuttle piston and the female part and for interacting at least with the interaction area of the male part in a force-fitting manner.

2. The connector unit of claim 1, wherein the at least one magnetic connecting device comprises at least one magnetic structure, the at least one magnetic connecting aid comprises at least one interaction device that corresponds to the magnetic structure, or a combination thereof.

3. The connector unit of claim 2, wherein the magnetic structure comprises a potted magnet or a magnet assembly, the magnet assembly comprises at least two sections with differently oriented magnetic poles, the interaction device of the magnetic connecting aid comprises a high permeability material, or any combination thereof.

4. The connector unit of claim 3, wherein the magnetic structure is arranged axially moveable inside the shuttle piston.

5. The connector unit of claim 3, wherein the shuttle piston comprises at least one region out of a high permeability material provided to engage a magnetic field of at least one magnetic section of the magnetic structure to reduce the magnetic field of the at least one magnetic section.

6. The connector unit of claim 5, wherein the at least one region out of the high permeability material is at least one part of a pin insertable through a hole of the magnetic structure, the at least one region is a shell arrangeable at least partially around a circumference of the magnetic structure, or a combination thereof.

7. The connector unit of claim 3, wherein the magnet assembly comprises at least one effective surface, the effective surface of the magnet assembly comprises at least two magnetic areas providing equal amounts of magnetic force, the magnetic forces having contrariwise magnetic orientations, or a combination thereof.

8. The connector unit of claim 3, wherein the magnet assembly is placed on at least a base out of a high permeability material.

9. The connector unit of claim 2, wherein the magnetic structure comprises at least one hydraulic damping device to limit a movement speed of the magnetic structure.

10. The connector unit of claim 9, wherein the at least one hydraulic damping device comprises at least one flow channel for a lubricant.

11. The connector unit of claim 1, wherein the shuttle piston further comprises at least one dirt seal that is mounted in an opening of the shuttle piston to prevent entering of dirt into the shuttle piston.

12. The connector unit of claim 1, wherein the backing latch comprises at least one spring loaded pin that is arranged radial with respect to an axis of the female part, the latching structure of the shuttle piston is configured as at least one groove that extends in circumferential direction of the shuttle piston, the spring loaded pin of the female part being latchable with the at least one groove of the shuttle piston, or a combination thereof.

13. The connector unit of claim 12, wherein the backing latch comprises at least one chamfer, and wherein the at least one groove of the shuttle piston comprises at least one contour configured correspondingly to a contour of the at least one spring loaded pin of the backing latch.

14. The connector unit of claim 12, wherein the at least one spring loaded pin of the backing latch comprises at least one rounded tip, the shuttle piston, the male part, or the shuttle piston and the male part comprise at least one planar surface, or a combination thereof, and wherein the at least one rounded tip of the spring loaded pin is engageable with the at least one planar surface in a force-fitting manner.

15. A method for establishing a connection between a male part and a female part of a connector unit using a shuttle piston of the connector unit, the method comprising:

pushing at least a magnetic connecting aid of the male part against the shuttle piston until at least a magnetic connection between the shuttle piston and the male part is established by a magnetic mechanism of the shuttle piston, thereby providing a fixed connection between the shuttle piston and the male part, wherein the shuttle piston is locally fixed in at least a force-fitting manner at the female part by a backing latch of the female part during the connection of the male part and the shuttle piston; and moving the male part with the connected shuttle piston relative to the female part and thereby unlatching at least the force-fitting connection between the female part and the shuttle piston until the female part connects at least the shuttle piston in a force-fitting manner, thereby providing a fixed connection between the male part and the female part.

16. The method of claim 15, wherein the shuttle piston comprises at least one region out of a high permeability material provided to engage a magnetic field of at least one magnetic section of the magnetic structure to reduce the magnetic field of the at least one magnetic section.

17. The method of claim 16, wherein the at least one region out of the high permeability material is at least one part of a pin insertable through a hole of the magnetic structure, the at least one region is a shell arrangeable at least partially around a circumference of the magnetic structure, or a combination thereof.

18. A method for releasing a connection between a male part and a female part of a connector unit using a shuttle piston of the connector unit, the method comprising:

moving the male part with the connected shuttle piston relative to the female part until at least a force-fitting connection between the shuttle piston and the female part is established by a backing latch of the female part, thereby providing a fixed connection between the shuttle piston and the female part, wherein the male part is locally fixed in at least a magnetic manner with the shuttle piston by a magnetic mechanism of the shuttle piston during the movement of the male part relative to the female part; and moving the male part relative to the shuttle piston until at least the magnetic connection between the shuttle piston and the male part established by the magnetic mechanism of the shuttle piston is disconnected, thereby disconnecting the male part from the shuttle piston.

19. The method of claim 18, wherein the shuttle piston comprises at least one region out of a high permeability material provided to engage a magnetic field of at least one magnetic section of the magnetic structure to reduce the magnetic field of the at least one magnetic section.

20. The method of claim 19, wherein the at least one region out of the high permeability material is at least one part of a pin insertable through a hole of the magnetic structure, the at least one region is a shell arrangeable at least partially around a circumference of the magnetic structure, or a combination thereof.

* * * * *